US007626557B2

(12) United States Patent
Eckwielen et al.

(10) Patent No.: US 7,626,557 B2
(45) Date of Patent: Dec. 1, 2009

(54) DIGITAL UHF/VHF ANTENNA

(75) Inventors: Bradley Lee Eckwielen, Ootsburg, WI (US); David LeRoy Hagen, Goshen, IN (US)

(73) Assignee: Bradley L. Eckwielen, Oostburg, WI (US)

( * ) Notice: Subject to any disclaimer, the term of this patent is extended or adjusted under 35 U.S.C. 154(b) by 229 days.

(21) Appl. No.: 11/731,099

(22) Filed: Mar. 31, 2007

(65) Prior Publication Data

US 2007/0229379 A1 Oct. 4, 2007

Related U.S. Application Data

(60) Provisional application No. 60/787,981, filed on Mar. 31, 2006.

(51) Int. Cl.
*H01Q 3/00* (2006.01)

(52) U.S. Cl. ..... 343/757; 343/727; 343/797; 343/878

(58) Field of Classification Search ..... 343/727, 343/757, 797, 811, 853, 878, 893
See application file for complete search history.

(56) References Cited

U.S. PATENT DOCUMENTS

| | | | |
|---|---|---|---|
| 2,270,314 | A | 1/1942 | Kraus |
| 2,430,353 | A | 11/1947 | Masters |
| 2,551,586 | A | 5/1951 | Dobler et al. |
| 2,615,005 | A | 10/1952 | White |
| 2,691,730 | A | 10/1954 | Lo |
| RE23,960 | E | 3/1955 | Lorusso |
| 2,714,659 | A | 8/1955 | Johnson et al. |
| 2,888,678 | A | 5/1959 | Weiss et al. |
| 2,897,496 | A | 7/1959 | Woodward, Jr. |
| 2,941,206 | A | 6/1960 | Finneburgh, Jr. |
| 2,975,423 | A | 3/1961 | Wells |
| 3,167,775 | A | 1/1965 | Guertler |
| 3,344,431 | A | 9/1967 | Greenberg et al. |
| 3,362,026 | A | 1/1968 | Smith, Jr. et al. |
| 3,440,658 | A | 4/1969 | Bogner |
| 3,475,759 | A | 10/1969 | Winegard |
| 3,482,250 | A | 12/1969 | Maner |
| 3,503,074 | A | 3/1970 | Carter |

(Continued)

OTHER PUBLICATIONS

Anon, Model HD-7080P Platinum Series High Definition VHF/UHF Antenna, Winegard Company, 3000 Kirkwood St., Burlington IA 52601-2000 Rev. 4/02, Downloaded from http://www.winegard.com/offair/pdf/HD7080P.pdf.

(Continued)

*Primary Examiner*—Douglas W. Owens
*Assistant Examiner*—Chuc Tran

(57) ABSTRACT

The invention comprises a Digital UHF/VHF (DUV) Antenna with a driven DUV antenna preferably boosted by an amplifier mounted close to the DUV dipole and a DUV signal line with antenna, amplifier, and signal line contacts being conductively bonded. The DUV dipole is preferably enhanced by a VHF enhancer and/or by a UHF enhancer comprising one of a reflective and a directive element. The UHF/VHF enhancer preferably includes an RF booster with a reflective element displaced from the longitudinal axis and near the driven antenna to enhance VHF signals. The DUV antenna is preferably configured for DTV reception in the VHF high band range of 174 MHz to 216 MHz, and in the UHF range of 470 MHz to 698 MHz.

42 Claims, 10 Drawing Sheets

U.S. PATENT DOCUMENTS

| | | | | |
|---|---|---|---|---|
| 3,518,693 | A | 6/1970 | Winegard et al. | |
| 3,534,369 | A | 10/1970 | Rea | |
| 3,550,144 | A | 12/1970 | Barbano et al. | |
| 3,573,841 | A * | 4/1971 | Greenberg | 343/802 |
| 3,576,580 | A | 4/1971 | Enyedy | |
| 3,599,217 | A | 8/1971 | Grant | |
| 3,618,103 | A | 11/1971 | Ringland | |
| 3,653,056 | A | 3/1972 | Peterson | |
| 3,710,337 | A | 1/1973 | Grant | |
| 3,727,232 | A | 4/1973 | Grant | |
| 3,931,626 | A | 1/1976 | Simons | |
| 3,950,756 | A * | 4/1976 | Tisler | 343/766 |
| 3,982,248 | A | 9/1976 | Archer | |
| 3,984,841 | A | 10/1976 | Mikulich, Jr. et al. | |
| 4,010,473 | A | 3/1977 | DiMeo | |
| 4,114,163 | A | 9/1978 | Browick | |
| 4,145,696 | A | 3/1979 | Gueguen | |
| 4,160,980 | A | 7/1979 | Murray | |
| 4,251,818 | A | 2/1981 | Lander | |
| 4,290,071 | A | 9/1981 | Fenwick | |
| 4,293,861 | A | 10/1981 | Winegard | |
| 4,308,540 | A | 12/1981 | Winegard et al. | |
| 4,398,201 | A | 8/1983 | Winegard et al. | |
| 4,518,968 | A | 5/1985 | Hately | |
| 4,604,628 | A * | 8/1986 | Cox | 343/818 |
| 4,667,204 | A | 5/1987 | Hedrick | |
| 4,812,855 | A | 3/1989 | Coe | |
| 5,497,166 | A | 3/1996 | Mahnad | |
| 5,612,706 | A | 3/1997 | Podell | |
| 5,666,126 | A | 9/1997 | Lange | |
| 5,841,406 | A | 11/1998 | Smith | |
| 5,898,410 | A | 4/1999 | DeMarre | |
| 6,133,889 | A | 10/2000 | Yarsunas et al. | |
| 6,154,180 | A * | 11/2000 | Padrick | 343/722 |
| 6,181,292 | B1 | 1/2001 | Dobravolny | |
| 6,255,998 | B1 * | 7/2001 | Podger | 343/867 |
| 6,498,589 | B1 | 12/2002 | Horii | |
| 6,606,074 | B1 * | 8/2003 | Allnutt | 343/815 |
| 6,621,463 | B1 | 9/2003 | Lam | |
| D480,387 | S | 10/2003 | Burns | |
| 6,650,300 | B2 | 11/2003 | Skalina et al. | |
| 6,677,914 | B2 | 1/2004 | Mertel | |
| 6,774,863 | B2 | 8/2004 | Shirosaka et al. | |
| 6,842,141 | B2 | 1/2005 | Suh et al. | |
| 6,859,182 | B2 * | 2/2005 | Horii | 343/727 |
| 6,859,189 | B1 | 2/2005 | Ramirez et al. | |
| 6,922,179 | B2 | 7/2005 | McCollum | |
| 6,930,649 | B1 | 8/2005 | Sergi | |
| 6,977,624 | B1 | 12/2005 | Szente | |
| 7,015,868 | B2 | 3/2006 | Puente Ballarde et al. | |
| 7,071,891 | B2 | 7/2006 | Shirosaka et al. | |
| 7,205,953 | B2 | 4/2007 | Knadle, Jr. et al. | |
| 7,205,955 | B2 | 4/2007 | Shirosaka et al. | |
| 7,215,294 | B2 | 5/2007 | Jocher | |
| 7,292,199 | B2 | 11/2007 | Horii | |
| 2007/0063909 | A1 | 3/2007 | Fujita et al. | |
| 2008/0018550 | A1 | 1/2008 | Horii | |

OTHER PUBLICATIONS

Anon. Model HD-7010 VHF/UHF/FM Antenna, Kirkwood St., Burlington IA 52601-2000 Rev. 6/01, Downloaded from http://www.winegard.com/offair/pdf/HD-7010.pdf.

Anon. Model HD-7015 VHF/UHF/FM Antenna, Winegard Company, 3000 Kirkwood St., Burlington IA 52601-2000 Rev. 6/01, Downloaded from http://www.winegard.com/offair/pdf/HD-7015.pdf.

Anon. Model HD-7082P Platinum Series High Definition VHF/UHF Antenna, Winegard Company, 3000 Kirkwood St., Burlington IA 52601-2000 Rev. 4/02, Downloaded from http://www.winegard.com/offair/pdf/HD7082P.pdf.

Anon. Models SS-1000 & SS-2000 HDTV SquareShooter Antenna System, Winegard Company, 3000 Kirkwood St., Burlington IA 52601 Rev. 7/05, Downloaded from http://www.winegard.com/offair/pdf/WC-811.pdf, 2000.

Anon. Model HD-5030 HD Series VHF/FM Antenna, Winegard Company, 3000 Kirkwood St., Burlington IA 52601-2000 Rev. 6/01, Downloaded from http://www.winegard.com/offair/pdf/HD-5030.pdf.

Anon. Model YA-1713 Broadband YAGI Antenna, Winegard Company, 3000 Kirkwood St., Burlington IA 52601-2000 Downloaded from http://www.winegard.com/offair/pdf/Ya-1713.pdf.

Anon. Model YA-6260 Broadband YAGI Antenna, Winegard Company, 3000 Kirkwood St., Burlington IA 52601-2000 Rev. 6/01 Downloaded from http://www.winegard.com/offair/pdf/Ya-6260.pdf.

Anon. Model HD-9095P, High Definition UHF Antenna, Winegard Company, 3000 Kirkwood St., Burlington IA 52601-2000 Rev. 2/02, Downloaded from http://www.winegard.com/offair/pdf/HD99095P.pdf.

Anon.Winegard High Definition (HD) Platinum Antennas, Instructions, VHF/UHF Models HD9065, HD9085P, HD9095P. Winegard Company, 3000 Kirkwood St., Burlington IA 52601-2000 Rev. 1/02, Downloaded from http://winegard.com/offair/pdf/1450173.pdf.

Anon. Model HD7084P, High Definition VHF/UHF Antenna, Winegard Company, 3000 Kirkwood St., Burlington IA 52601-2000 Rev. 4/02, Downloaded from http://www.winegard.com/offair/pdf/HD7084P.pdf.

Anon. Model HD-9075P, High Definition UHF Antenna, Winegard Company, 3000 Kirkwood St., Burlington IA 52601-2000 Rev. 2/02, Downloaded from http://www.winegard.com/offair/pdf/HD99075P.pdf.

Anon. Model HD-9032, High Definition UHF Antenna, Winegard Company, 3000 Kirkwood St., Burlington IA 52601-2000 Rev. 6/01, Downloaded from http://www.winegard.com/offair/pdf/HD9032.pdf.

Anon. Model HD 9022, HD Series UHF Antenna, Winegard Company, 3000 Kirkwood St., Burlington IA 52601-2000 Rev. 6/01, Downloaded from http://www.winegard.com/offair/pdf/HD9022.pdf.

Anon. Model HD4400, HD Series UHF Antenna, Winegard Company, 3000 Kirkwood St., Burlington IA 52601-2000 Downloaded from http://www.winegard.com/offair/pdf/HD4400.pdf.

Anon. Model HD8800, HD Series UHF Antenna, Winegard Company, 3000 Kirkwood St., Burlington IA 52601-2000 Downloaded from http://www.winegard.com/offair/pdf/HD8800.pdf.

Anon. Model HD6055P , Platinum Series High Definition FM Antenna, Winegard Company, 3000 Kirkwood St., Burlington IA 52601-2000 Rev. 6/02. Downloaded from http://www.winegard.com/offair/pdf/HD6055P.pdf.

Anon. Model HD6010 , HD FM Antenna, Winegard Company, 3000 Kirkwood St., Burlington IA 52601-2000 Downloaded from http://www.winegard.com/offair/pdf/HD6010.pdf.

Anon. Model HD6000, HD FM Antenna, Winegard Company, 3000 Kirkwood St., Burlington IA 52601-2000 Rev. 6/01 Downloaded from http://www.winegard.com/offair/pdf/HD6000.pdf.

Anon. Model SS-3000, Indoor HDTV Antenna, Winegard Company, 3000 Kirkwood St., Burlington IA 52601 (c) 2006 Winegard Co. Downloaded from http://www.winegard.com/offair/pdf/SS-3000.htm.

Anon. Model GS-1100 non-amplified & GS-2000 amplified, Sensar III, Bi-directional antenna for UHF/VHF reception, Winegard Company, 3000 Kirkwood St., Burlington IA 52601, S:\engspec\gs-2200 Downloaded from http://winegard.com/offair/pdf/GS-2200.pdf.

HDP-269 Preamp, Winegard Company, 3000 Kirkwood St., Burlington IA 52601-2000 2004-2006, Downloaded from: http://www.winegard.com/offair/pdf/WC-809%20%20HDP-269.pdf.

Anon. Model 5885 ColorKing VHF/UHF/FM Antenna Antennacraft Specification Sheet, Antennacraft, P.O. Box 1005, Burlington, IA 52601, Dec. 2001, Downloaded from: http://www.antennacraft.net/pdfs/5885.pdf.

Anon. Model 5884 ColorKing VHF/UHF/FM Antenna, Antennacraft Specification Sheet, Antennacraft, P.O. Box 1005, Burlington, IA 52601, Dec. 2001, Downloaded from: http://www.antennacraft.net/pdfs/5884.pdf.
Anon. Model HDX1000 HDTV UHF/VHF Antenna, Engineering Specification Sheet, Antennacraft, P.O. Box 1005, Burlington, IA 52601, Dec. 2001, Downloaded from: http://www.antennacraft.net/pdfs/HDX1000.pdf.
Anon. Model No. U-8000, Engineering Specifications, Antennacraft, P.O. Box 1005, Burlington, IA 52601, U-8000xls, Rev. 8-1-2007, Downloaded from: http://www.antennacraft.net/pdfs/U8000.pdf.
Anon. Model No. U-4000, Engineering Specifications, Antennacraft, P.O. Box 1005, Burlington, IA 52601, U-4000.xls Rev. 8-1-2007, Downloaded from: http://www.antennacraft.net/pdfs/U4000.pdf.
Anon. Model CCS1843 VHF/UHF/FM Antenna, Engineering Specifications, Antennacraft, P.O. Box 1005, Burlington, IA 52601, Dec. 2001, Downloaded from: http://www.antennacraft.net/pdfs/CCS1843.pdf.
Anon. Model CCS1233 VHF/UHF/FM Antenna, Engineering Specifications, Antennacraft, P.O. Box 1005, Burlington, IA 52601, Dec. 2001, Downloaded from: http://www.antennacraft.net/pdfs/CCS1233.pdf.
Anon. Model C480 VHF/UHF/FM Antenna, Engineering Specifications, Antennacraft, P.O. Box 1005, Burlington, IA 52601, Dec. 2001, Downloaded from: http://www.antennacraft.net/pdfs/C480.pdf.
Anon. Model HD1850 Heavy-Duty, High Definition VHF/UHF/FM Antenna, Engineering Specifications, Antennacraft, P.O. Box 1005, Burlington, IA 52601, May 2003, Downloaded from: http://www.antennacraft.net/pdfs/HD1850.pdf.
Anon. Model HD1800 Heavy-Duty, High Definition VHF/UHF/FM Antenna, Engineering Specifications, Antennacraft, P.O. Box 1005, Burlington, IA 52601, May 2003, Downloaded from: http://www.antennacraft.net/pdfs/HD1800.pdf.
Anon. Model HD1200 Heavy-Duty, High Definition VHF/UHF/FM Antenna, Engineering Specifications, Antennacraft, P.O. Box 1005, Burlington, IA 52601, May 2003, Downloaded from: http://www.antennacraft.net/pdfs/HD1200.pdf.
Anon. Model HD850 Heavy-Duty, High Definition VHF/UHF/FM Antenna, Engineering Specifications, Antennacraft, P.O. Box 1005, Burlington, IA 52601, May 2003, Downloaded from: http://www.antennacraft.net/pdfs/HD850.pdf.
Anon. Model AC9 VHF/UHF/FM, Engineering Specifications, Antennacraft, P.O. Box 1005, Burlington, IA 52601, Dec. 2001, Downloaded from: http://www.antennacraft.net/pdfs/AC9.pdf.
Anon. Model 4BG26 Permacolor UHF/VHF/FM, Engineering Specifications, Antennacraft, P.O. Box 1005, Burlington, IA 52601, Dec. 2001, Downloaded from: http://www.antennacraft.net/pdfs/4BG26.pdf.
Anon, Model CCS822 VHF/UHF/FM Antenna, Engineering Specifications, Antennacraft, P.O. Box 1005, Burlington, IA 52601, Dec. 2001, Downloaded from: http://www.antennacraft.net/pdfs/CCS822.pdf.
Anon. Model CS1100 VHF/FM Antenna, Engineering Specifications, Antennacraft, P.O. Box 1005, Burlington, IA 52601, Dec. 2001, Downloaded from: http://www.antennacraft.net/pdfs/CS1100.pdf.
Anon. Model CS600 VHF/FM Antenna, Engineering Specifications, Antennacraft, P.O. Box 1005, Burlington, IA 52601, Dec. 2001, Downloaded from: http://www.antennacraft.net/pdfs/CS600.pdf.
Anon. Model MXU47 UHF Antenna, Engineering Specifications, Antennacraft, P.O. Box 1005, Burlington, IA 52601, Dec. 2001, Downloaded from: http://www.antennacraft.net/pdfs/MXU47.pdf.
Anon. Model MXU59 UHF Antenna, Engineering Specifications, Antennacraft, P.O. Box 1005, Burlington, IA 52601, Dec. 2001, Downloaded from: http://www.antennacraft.net/pdfs/MXU59.pdf.
Anon, Model HBU22 Hi-Band VHF and UHF Antenna, Engineering Specifications, Antennacraft, P.O. Box 1005, Burlington, IA 52601, Dec. 2001, Downloaded from: http://antennacraft.net/pdfs/MXU59.pdf.
Anon, HBU22 Manual, Antennacraft, P.O. Box 1005, Burlington, IA 52601, 7ALLCHANIS 507, www.antennacraft.net Downloaded from: http://www.antennacraft.net/Manuals/Generic-VHF-UHF.pdf, 2001.
Get the Clearest Picture, Channel Master, Reception and Connectivity Consumer & Professional Products, Antennas Special Market, pp. 1-16, (c) 2006 Channel Master, a division of PCT International Inc. Pub PCTCM001.200611 Downloaded from http://www.channelmasterintl.com/pdfs/CHANNEL%20MASTER%20BY%20PCT%20CATALOG__20070410.pdf, 2001.
Richard C. Johnson, Antenna Engineering Handbook, 3rd Edition, ISBN 0-07-032381-X, Chapter 28, Raymond H. Duhamel & Ali R. Mahnad, TV & FM Transmitting Antennas; Chapter 29 Edward B. Joy, TV Receiving Antennas, 2006.
John D. Kraus et al., Antennas for All Applications, 3rd Edition, 2006, McGraw-Hill SIBN 0-07-060185-2, pp. 425-464.
Ken Nist, KQ6QV, Comparing some commercially available antennas. HDTVprimer, HDTV Magazine, Feb. 2, 2006. Downloaded from: http://www.hdtvprimer.com/ANTENNAS/comparing.html.
Ken Nist, Comparing some commercially available antennas, Appendices. HDTVprimer, HDTV Magazine, Feb. 2, 2006. Downloaded from: http://www.hdtvprimer.com/ANTENNAS/. Including, The Channel Master 4228 8-Bay; The Channel Master 4221 4-Bay; The Channel Master 4248; The Televes DAT-75; The Winegard PR-8800 8-Bay; The Winegard PR-4400 4-Bay; The Channel Master 4242 VHF/UHF combo; The Channel Master 3018; Small indoor loops; The Double Bowtie; The DB-2 from AntennasDirect.com; The Winegard Square Shooter; The Winegard.
Doug Lung, Antennas for DTV reception, Mar. 6, 2002, TV Technology.com, Downloaded from: http://www.tvtechnology.com/features/On-RF/antennas.shtml.
R. Dean Straw, N6BV, The ARRL Antenna Book, 20th Edition, (c)2003-2005 The AARL, Inc,, Newington CN, ISBN 0-87259-904-3, The Corner Reflector, pp. 18-14 to 18-17, 2006.

* cited by examiner

Fig. 3
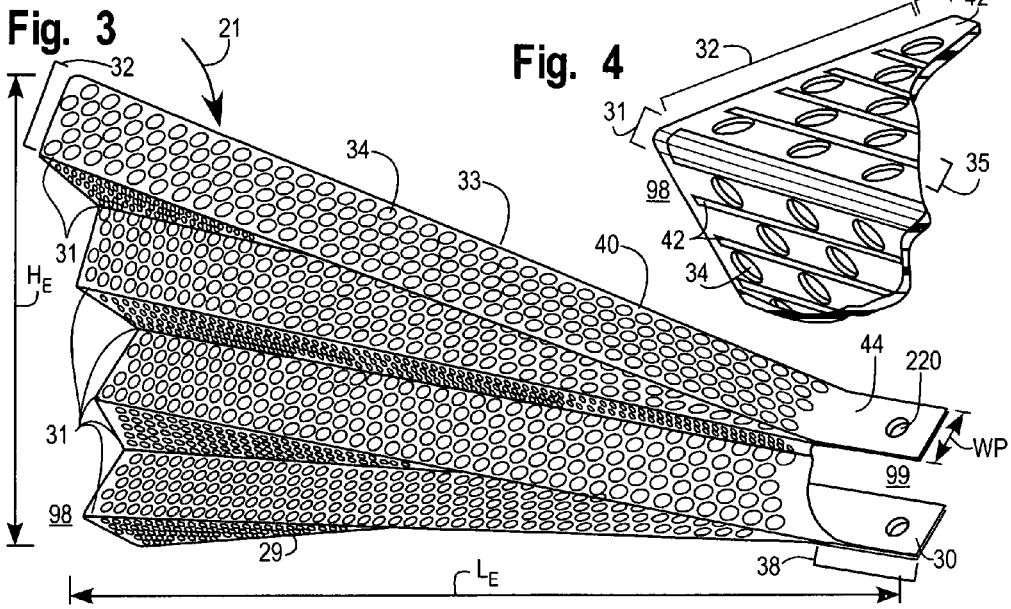
Fig. 4
Fig. 5
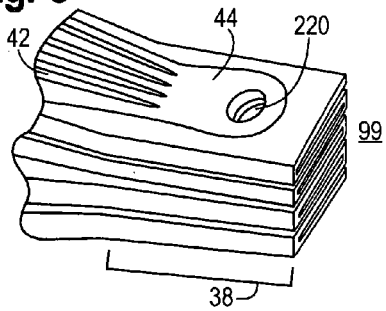
Fig. 6
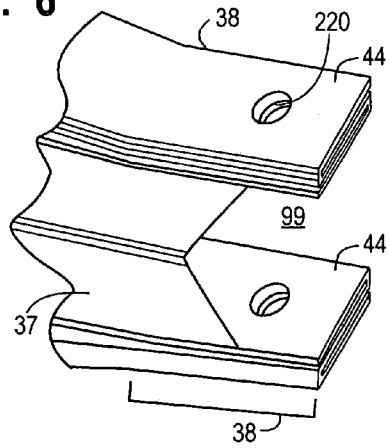
Fig. 7
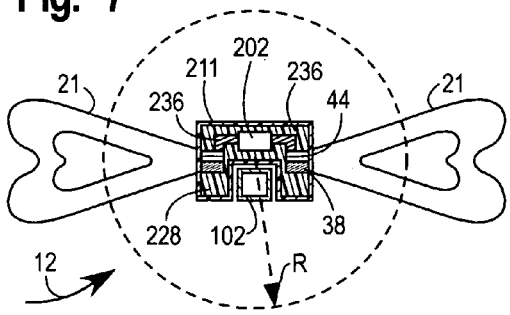
Fig. 8
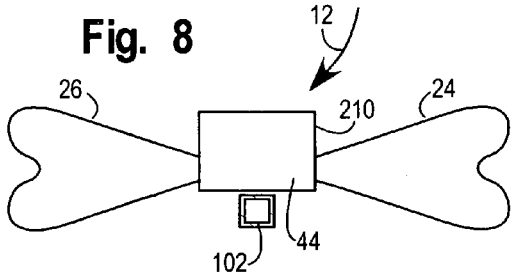

Fig. 19
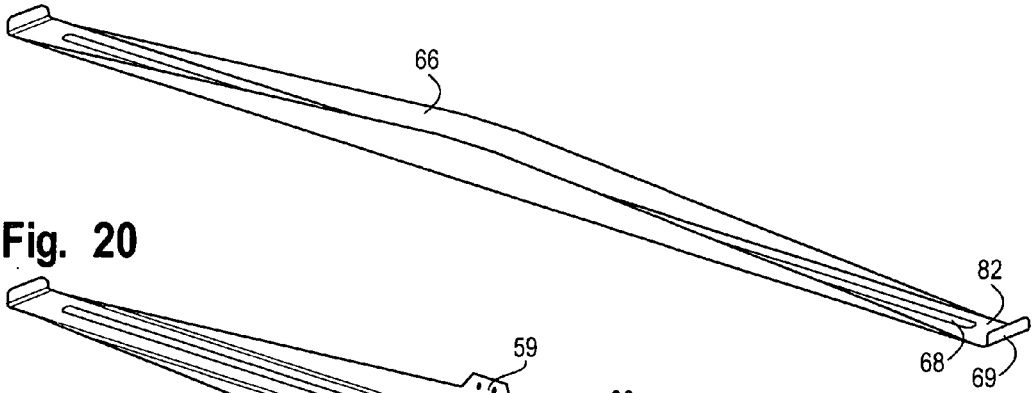
Fig. 20
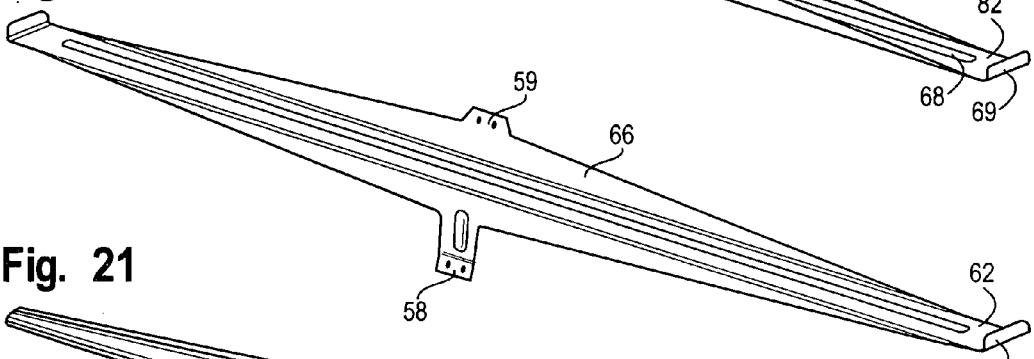
Fig. 21
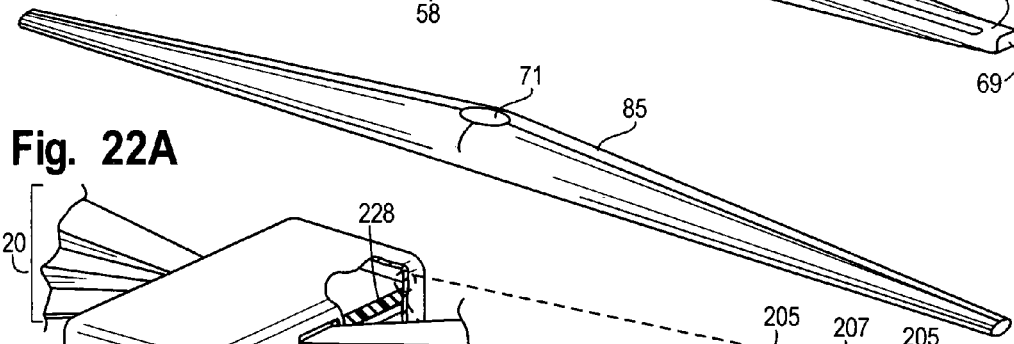
Fig. 22A
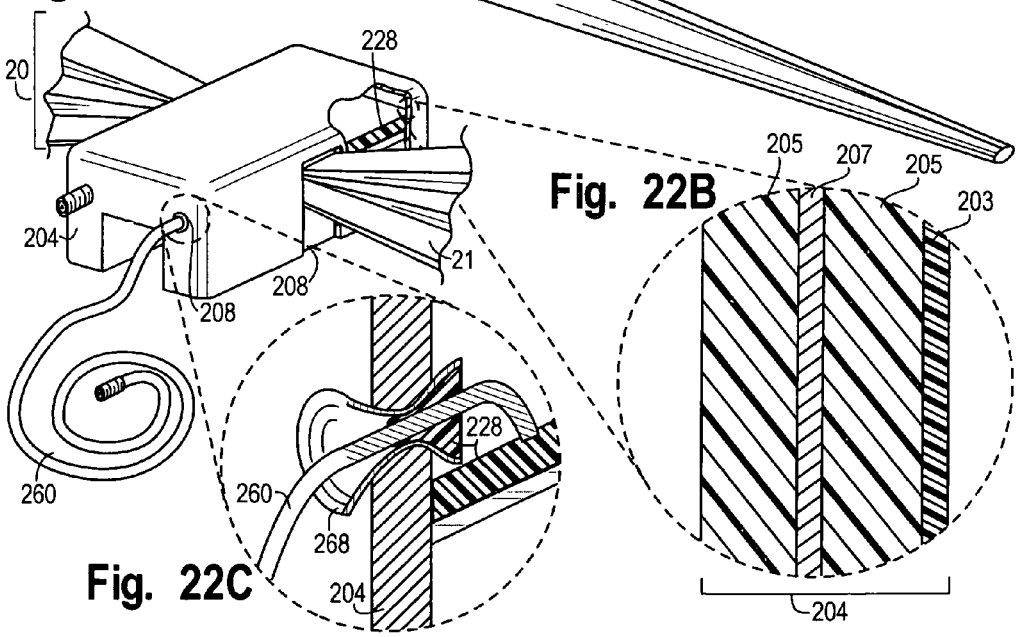
Fig. 22B
Fig. 22C

DIGITAL UHF/VHF ANTENNA

This application incorporates by reference the Non-Provisional Application "Modular Digital UHF VHF Antenna" filed on 31 Mar. 2007. This application claims the priority benefit under 35 U.S.C. .sctn. 119(e) of Provisional Application No. 60/787,981 "Digital UHF VHF Antenna" filed on Mar. 31, 2006.

BACKGROUND OF THE INVENTION

1. Field of Invention

This invention relates to antennas suitable for digital signals to increase the gain for receiving and/or transmitting signals in the Ultra High Frequency (UHF) and/or Very High Frequency (VHF) ranges.

2. Description of the Related Art

Marginal Performance: Digital Television (DTV) including High Definition Television (HDTV) is displacing analog TV because of its much higher image resolution. However, DTV requires minimum signal level to be useable. DTV signals below this threshold level typically result in no picture at all. E.g., while the US Federal Communications Commission (US FCC) requires a minimum 15.2 dBa Signal/Noise ratio, signals often cut out below about 17 dBa Signal to Noise (S/N) ratio compared to a strong signal having a S/N ratio of about 33 dBa. Multipath signals can cause serious reception problems, especially in urban areas. Signals with borderline Signal/Noise ratios result in pixilation and other unacceptable distortions. Relevant art UHF antennas are typically configured for at higher frequencies than the USA's digital TV channel allocations. Antennas designed UHF half wave dipole resonance have low VHF performance. The US FCC expects that many consumers will need to obtain new antennas for free to air DTV reception.

Corrosion: Typical antenna installations allow moisture to enter coax connectors and coax lines. This causes outside and even inside connector corrosion resulting in major signal attenuation over time. Many antennas use steel rivets or screws to hold aluminum elements, or to connect copper cables to steel connectors. Galvanic action corrodes contacts, increasing electrical impedance and degrading signal reception and/or transmission over time.

Wear: VHF and UHF antennas are commonly folded for shipment. Wind flexing of riveted or screwed elements causes joint movement and wear, loosens connections, and increases signal loss with time. Flimsy plastic or light metal element mounts frequently break, bend, or work loose in storms. Miss-alignment and/or loose or lost connections seriously degrade antenna gain.

Impedance mismatch: Most VHF prior relevant art utilizes 300 ohm antenna feed points. These antennas require impedance converters ("baluns") from 300 ohm antenna feed points to 75 ohm (or 52 ohm) cable with corresponding extra connection points. With VHF/UHF antennas, such baluns typically causes 1.5 dB to 6 dB insertion losses with UHF signals, attenuating a major portion of the typical 4 dB to 8 dB UHF antenna gain.

Cable loss: Even using quality RG-6 75 Ohm coax cable, high UHF signals are often attenuated within the connecting cable by 50% to 75% or more of the signal gain obtained by high gain antenna. E.g., the FCC (2005) expects signal attenuation of about 4 dB for a 15 m (50 ft) downlink for 470-800 MHz (Channels 14-69) signal in RG-6 coax cable compared to an 8 dB gain using a good Yagi UHF antenna.

Increased Transmission: Digital TV transmission is often increased to 1,000 kW or more to accommodate higher losses and minimum S/N reception requirements. Relevant art antenna amplifiers (or "preamps") configured for 50 kW transmission often saturate and distort ("splatter") when receiving such stronger DTV TV transmissions. This can cause digital signal dropout, especially near high power TV transmitters.

Generic performance: Increasing propagation distances and signal degrading environments are commonly categorized as "Urban, "Suburban", "Far Suburban", "Mid Fringe" and "Deep Fringe" reception regions. Generic broadband antenna systems are typically unnecessarily expensive if used near to transmitters in Urban and even Suburban areas. Yet they may be marginal in Mid Fringe areas and are often unusable in Deep Fringe areas.

Complex: Numerous antenna systems are complex and difficult to install with confusing instructions. E.g., one prior art high gain VHF/UHF antenna shown in FIG. 23 (see U.S. Pat. No. 3,531,805). As further depicted in that prior art, VHF antenna supports often use highly complex VHF elements with numerous mounting components and phasing lines. These have numerous contacts and mounts that are prone to corrosion, wear and failure. Long elements are often folded for shipping and users frequently do not unfold elements. FIG. 24 shows the corresponding short 168 mm (6.63") prior art "Peterson" folded VHF/UHF driven dipole element. Such relevant art UHF designs are no longer optimized for UHF DTV signals.

Low VHF/UHF reception: The US Federal Communications Commission (Dec. 2005 Report 05-199) plans on antennas with 6 dB gain for the VHF High Band with a Front/Back ratio of 12 dB for distant DTV signals in "Fringe" areas. This FCC (2005) report plans on 10 dB gain for the UHF band with a Front/Back ratio of 14 dB. The conventional art uses large VHF antennas to achieve such VHF performance, especially for fringe regions. Most UHF antennas marketed for the Digital TV exhibit very low VHF gain. UHF enhancing screens of relevant art high gain UHF antennas show low VHF reception. Similarly a good UHF Yagi antenna while providing modest UHF gain, provides very little VHF reception. Many antennas advertised for VHF/UHF reception are described by third party evaluators as exhibiting marginal performance in the UHF range and very poor performance in the VHF range.

Low Signal/Noise Ratios: Analog TV or NTSC transmission, results in progressively degraded and increasingly fuzzier reception with increasing distance, intervening vegetation, and/or multipath signal transmission. While degraded, analog audio can often still be understood. However, amplifying signals with low antenna gain and/or long lossy lines degrades signal/noise ratios. This can cause instability or total dropout with both video and audio reception of DTV signals.

Physical Unattractiveness: Most high performance broadband VHF/UHF antennas have large obtrusive Log periodic structures or numerous bowtie elements with large screens. Small unobtrusive antennas give poor performance, especially in the VHF High Band range.

Wind loading: Relevant art antennas typically use box channel or cylindrical VHF elements resulting in substantial wind loading and wear.

OBJECTS AND ADVANTAGES

Some of the major objects and advantages of the invention are as follows:

Configure broadband antennas for Digital TV UHF and/or VHF High Band ranges.

Configure antennas for the Digital FM ranges.

Configure antennas for "mid fringe" regions up to 72 km to 80 km (45 to 50 miles) from transmitters.

Provide compact unobtrusive antennas.

Reduce wind induced antenna flexure and wear.

Transmit the received or transmission signal without major signal loss.

Transmit received signals without major degradation in signal to noise ratio.

Configure electrical connections to minimize or eliminate contact corrosion losses.

Configure electrical connections to minimize contact flexure wear and signal loss.

Provide efficient transfer of RF signals between the driven dipole and feed line.

Provide efficient transfer of RF signals between the feed line and a signal connector.

Reduce impact of solar, wind and lightning environmental conditions.

Provide a light weight simply constructed but highly durable antenna.

Provide very easy installation with simple instructions.

Eliminate most assembly and related errors.

SUMMARY OF THE INVENTION

A Digital UHF/VHF (DUV) antenna and configuration method are provided for the Radio Frequency (RF) range, especially the Ultra High Frequency (UHF) and Very High Frequency (VHF) ranges. Preferred embodiments are configured for the digital TV UHF DTV (Channels 14-51), the VHF High Band (Channels 7-13), and/or the Digital FM range. One unexpected development was obtaining substantial VHF High Band performance while retaining strong UHF DTV performance in some lightweight embodiments. E.g., by configuring a wideband driven DUV element or DUV antenna optionally boosted by multiple passive UHF enhancers, VHF enhancers and/or reflective RF boosters. The driven DUV antenna (or dipole) and RF enhancer(s) are supported by an antenna support which may comprise one or more of a DUV housing, a longitudinal boom, a boom-mast mount, an antenna mast, a mast-structure mount, a director boom, an off axis booster boom, a booster mount, intra antenna boom, a support spar and an offset. Such configurations form efficient lightweight DUV antennas—without the very large VHF log-periodic elements or numerous bowtie dipoles screens and corresponding complex corrosion prone connections commonly used.

The driven DUV antenna preferably comprises wideband DUV elements configured to resonate in one and more preferably in both a prescribed UHF range and a prescribed VHF range. E.g., within 30 MHz to 300 MHz in the VHF and 300 MHz to 3000 MHz in the UHF and preferably within the VHF High Band range of 170 MHz to 220 MHz, and UHF range of 470 MHz to 800 MHz. It may be configured to resonate near or in the FM band. (e.g., 88 MHz to 108 MHz). DUV antennas are more preferably configured for three halves wave resonance in the DTV UHF range and for half wave resonance near or in the VHF range. E.g., a wideband DTV DUV antenna is more preferably configured for half wave dipole resonance near or in the VHF High band from 170 MHz to 220 MHz while obtaining three halves resonance from about 510 MHz to 660 MHz within the DTV UHF band.

DUV antennas may further be configured for specialized ranges. For example, in one configuration a U-DUV dipole may be configured for half wave resonance near the top or above the VHF High band giving three halves resonance in the UHF band. E.g., half wave resonance above about 220 MHz giving three halves resonance above about 660 MHz. In one configuration, the U-DUV-230 UHF dipole is preferably configured for half wave resonance near about 230 MHz giving three halves resonance about 690 MHz near the upper end of the UHF DTV band (near 686 to 692 MHz for DTV Channel 51). Similarly, a medium M-DUV-213 dipole embodiment may be configured near the upper end of the VHF High Band for half wave resonance about 210-216 MHz (DTV Channel 13) and three halves UHF resonance about 630 to 648 MHz (near Channels 41-43). DUV dipoles may similarly be configured for broadband coverage of the 700 to 800 MHz range.

In further configurations, the driven DUV antenna or DUV dipole is preferably configured for five eighths resonance in the VHF band while providing three halves resonance in the UHF band. E.g., a V-DUV-170 dipole may be configured for half wave resonance about 170 MHz near the bottom of the VHF High Band range (near DTV Channel 7). This beneficially provides five eighths resonance at about 213 MHz in the upper end of the VHF High Band as well as three halves UHF resonance about 510 MHz. In another configuration, a V-DUV-157 dipole is preferably configured for five eighths resonance near the middle of the VHF High Band at about 196 MHz, and three halves resonance near the bottom of the UHF band about 470 MHz (with nominal half wave resonance about 157 MHz).

Similarly an F-DUV antenna may be configured for half wave resonance in or near the FM range (e.g., the VHF range of 88 MHz to 108 MHz.) Further examples of such DUV antenna configurations are shown in Table 1. Multiple specialized DUV dipoles or DUV antennas are preferably used to further improve reception in the UHF and VHF bands respectively in some embodiments. Generalizing, the driven antenna is preferably configured for a first odd to even rational number wave resonance in the prescribed UHF range, and for a second odd to even rational number wave resonance in the prescribed VHF range. These odd to even rational numbers preferably consist of an odd integer divided by an even integer. E.g., a rational number selected from one quarter, three eighths, one half, five eighths, three quarters, seven eighths, five quarters and three halves.

A Radio Frequency (RF) amplifier is preferably added to and close coupled with one or more RF contacts of the driven DUV element and/or DUV dipole to improve the amplitude and/or preserve the signal/noise ratio of the transmitted signal. The RF contacts of the DUV elements, the RF amplifier and the signal connector are preferably electrically bonded together with suitable lengths of high quality RF signal line. A RF fiber optic link between the RF amplifier and the signal connector is more preferably used to communicate the RF signal with minimal signal degradation and to preserve the amplified DUV antenna's high signal/noise ratio.

One or more RF enhancement elements supported by the antenna support are preferably added in some antenna configurations. These may comprise one or more of a UHF enhancement element comprising one of a UHF director element and a UHF reflector element, a VHF enhancement element comprising one of a VHF director element, and a VHF reflector element, and an RF booster comprising multiple reflective elements configured off of the longitudinal axis to reflect signals to/from the driven dipole. The director and/or reflector elements are preferably passive ("parasitic") elements mounted on the longitudinal boom. The reflective elements of the RF booster are preferably mounted on one or more booster booms supported by the longitudinal boom. These RF enhancements are preferably provided without RF VHF connections to the DUV dipole or RF amplifier.

Shorter UHF RF booster reflective elements are preferably configured above and below a longitudinal boom with a gap between the innermost reflective lower elements to enhance VHF reflection by a VHF reflector behind the DUV dipole. Longer VHF RF booster reflective elements preferably include a UHF reflector behind the DUV dipole to enhance the UHF performance. These RF booster configurations provide substantially improved VHF high band signal gain while retaining good UHF signal gain in a compact configuration.

UHF and/or VHF enhancement elements are preferably streamlined to reduce wind loading. DUV antennas are usually sufficiently compact to be shipped preassembled or with modest assembly. They preferably use bonded RF connections leaving just a few RF signal connections. More preferably inner RF connections on a DUV element or multiple DUV elements forming one or more DUV dipoles are RF communicatively connected to an RF signal line using bonded connections with only one signal connector at the end of the signal line. Multiple UHF and/or VHF DUV dipole antennas may be provided and/or stacked to further improve signal gain.

In some embodiments, a protective housing is preferably configured around the RF amplifier and the DUV dipole's RF contacts. The signal connectors are usually provided with environmental seals. The inner DUV dipole mounts, amplifier, and associated signal line contacts are preferably hermetically covered by epoxy or potting to protect against corrosive components such as water, improve strength, and increase reliability. In some configurations, the housing surface and composition are configured to reduce solar heat gain, RF reflection, and/or multipath signals. A lightning rod may be added to reduce lightning strike hazards.

DUV antennas are preferably mounted with a biconvex mount provides three degrees of freedom. Besides pointing the antenna azimuthally to obtain the best reception/transmission mix, the DUV antenna is preferably rotated about the antenna support's logitudinal pointing axis to orient the antenna within 75% and 125% of the local signal's maximum polarization or desired polarization. The DUV antenna is preferably configured vertically to position the driven antenna within one or more moire fringe RF signal maximums.

Such DUV antenna configurations eliminate almost all problems with multiple RF connections, connection wear, corrosion, and the associated signal losses. They provide consumers with a very simple signal connection. The DUV antennas are compact and relatively unobtrusive while giving very good performance from Metro to Fringe DTV regions. DUV antennas are configured for simplicity in assembly, eliminating most potential user assembly errors.

BRIEF DESCRIPTION OF THE DRAWINGS

Having thus summarized the general nature of the invention and some of its features and advantages, certain preferred embodiments and modifications thereof will become apparent to those skilled in the art from the detailed description herein having reference to the figures that follow, each having features and advantages in accordance with one embodiment of the invention, namely:

List of Drawings

Figure 1:
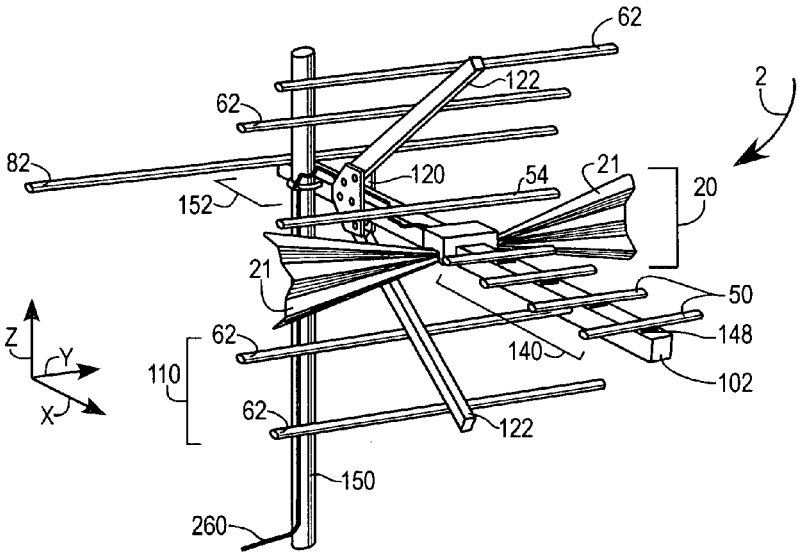
Figure 2:
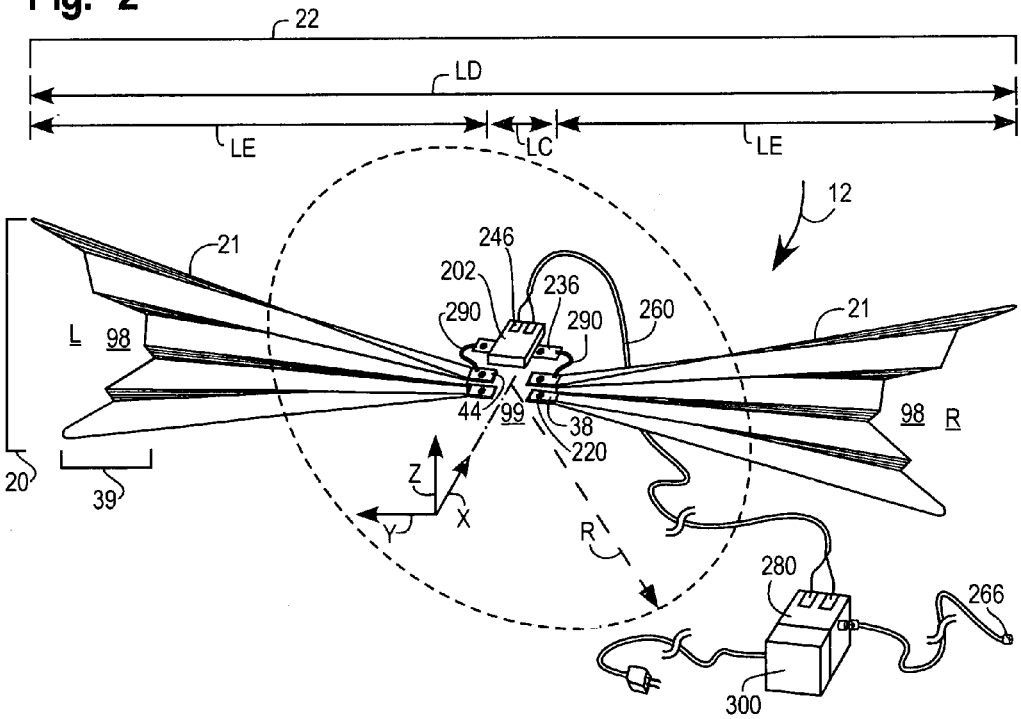

| | |
|---|---|
| FIG. 1 | Perspective view of a Digital UHF/VHF (DUV) antenna. |
| FIG. 2 | Exploded view of a DUV dipole and amplifier. |

-continued

List of Drawings

Figure 9:
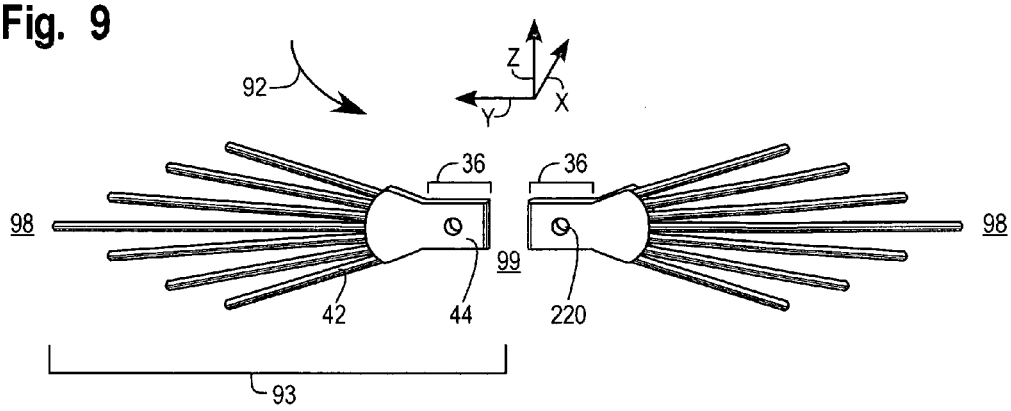
Figure 10:
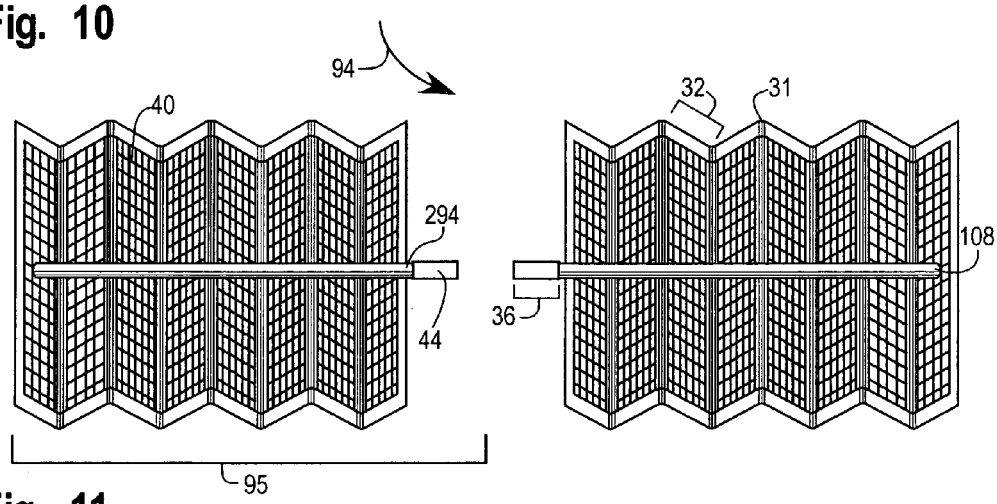
Figure 11:
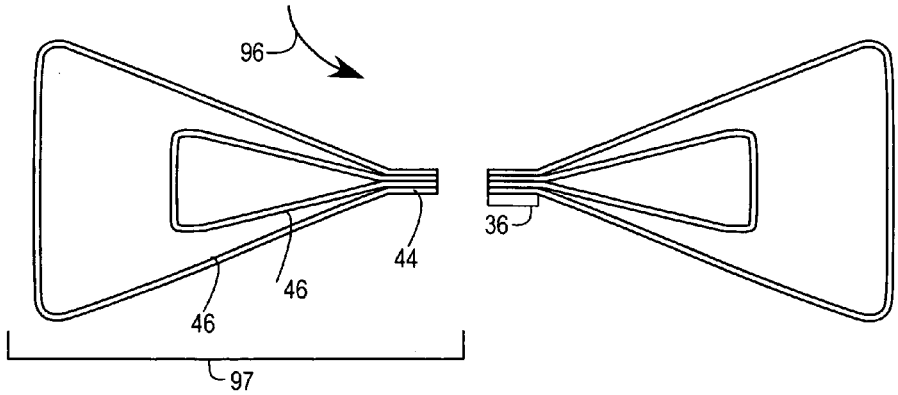
Figure 12:
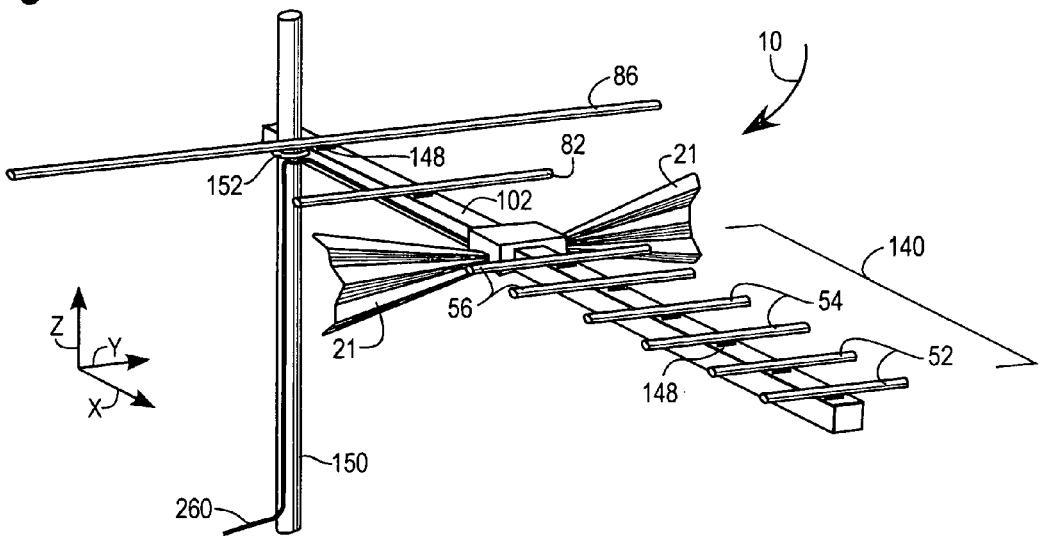
Figure 13:
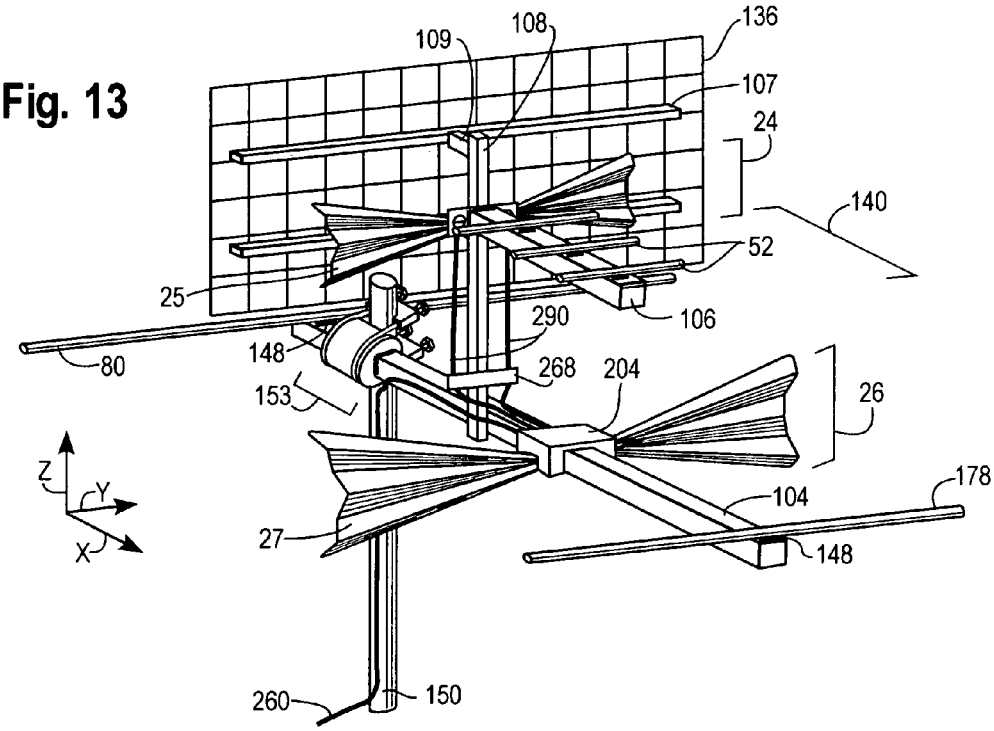
Figure 14:
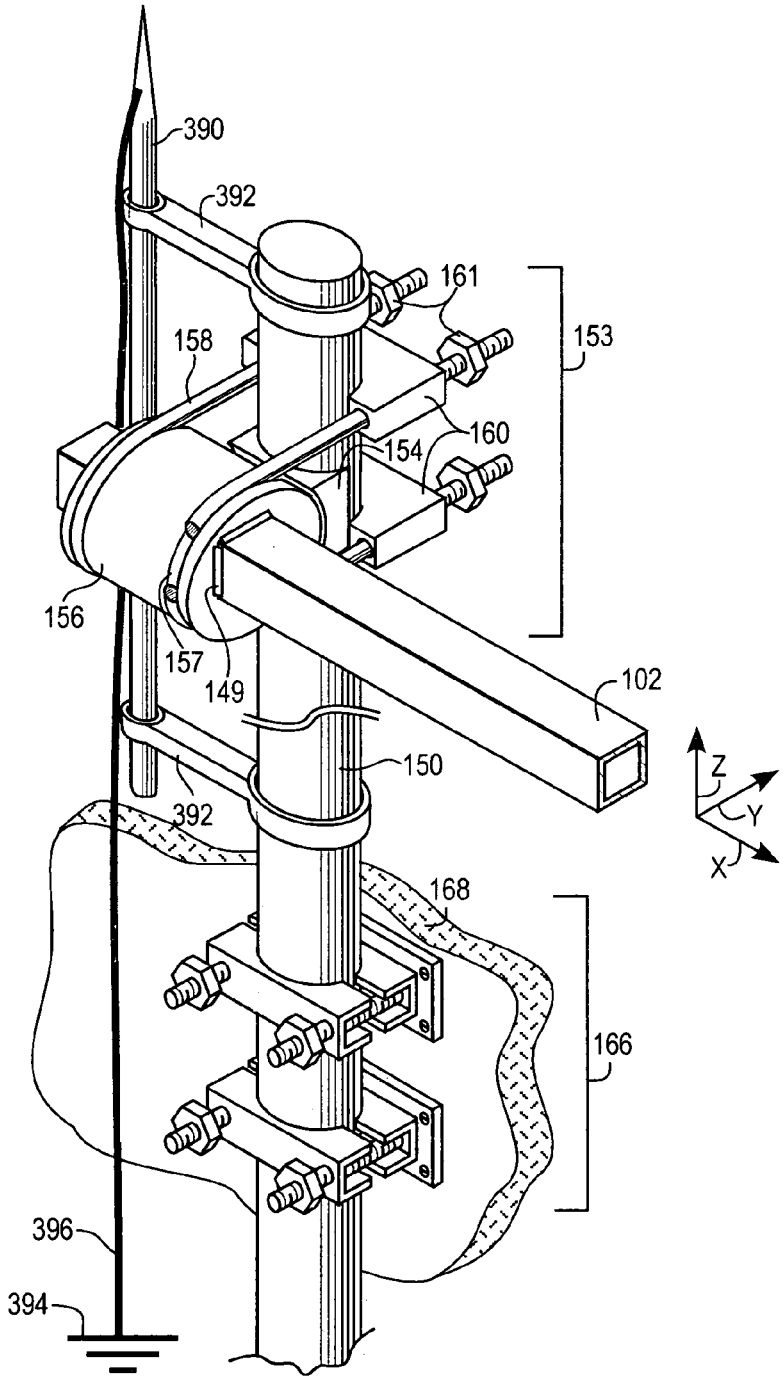
Figure 15:
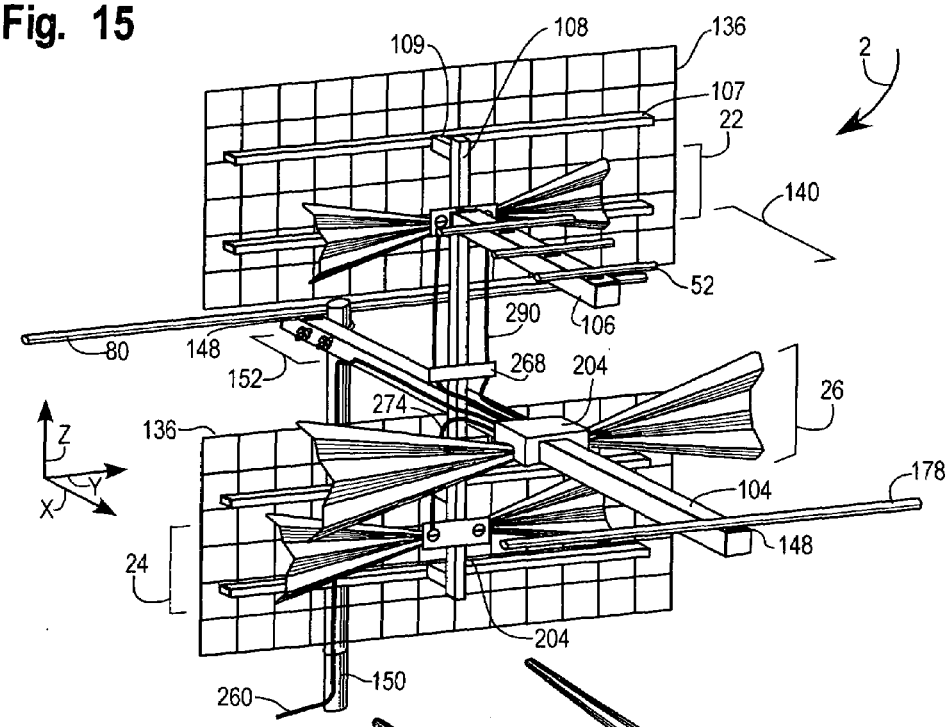
Figure 16:
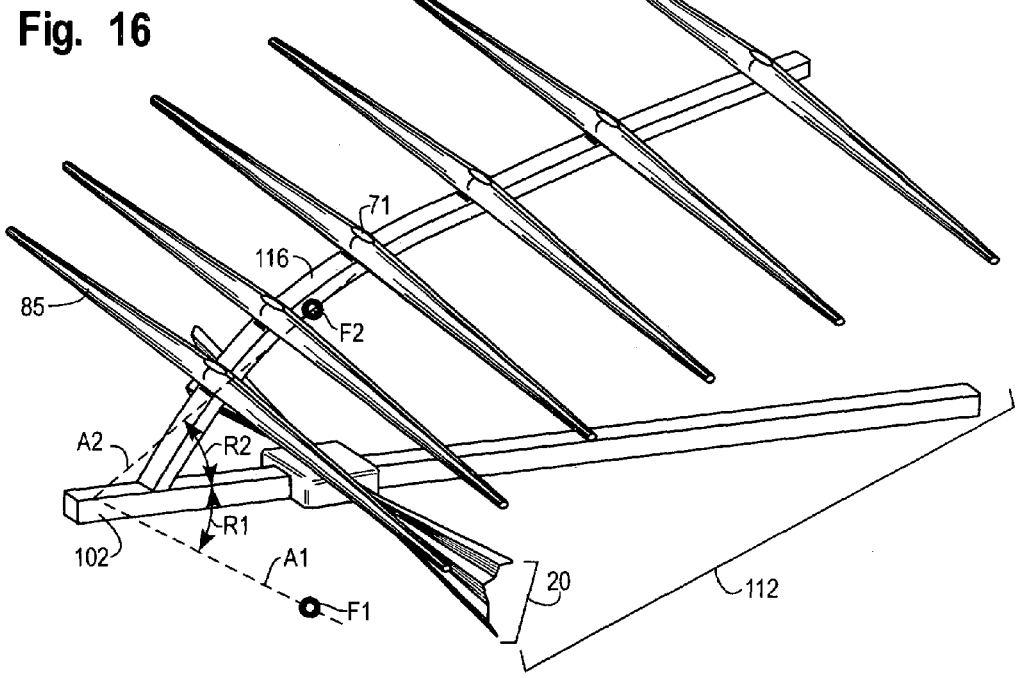
Figure 17:
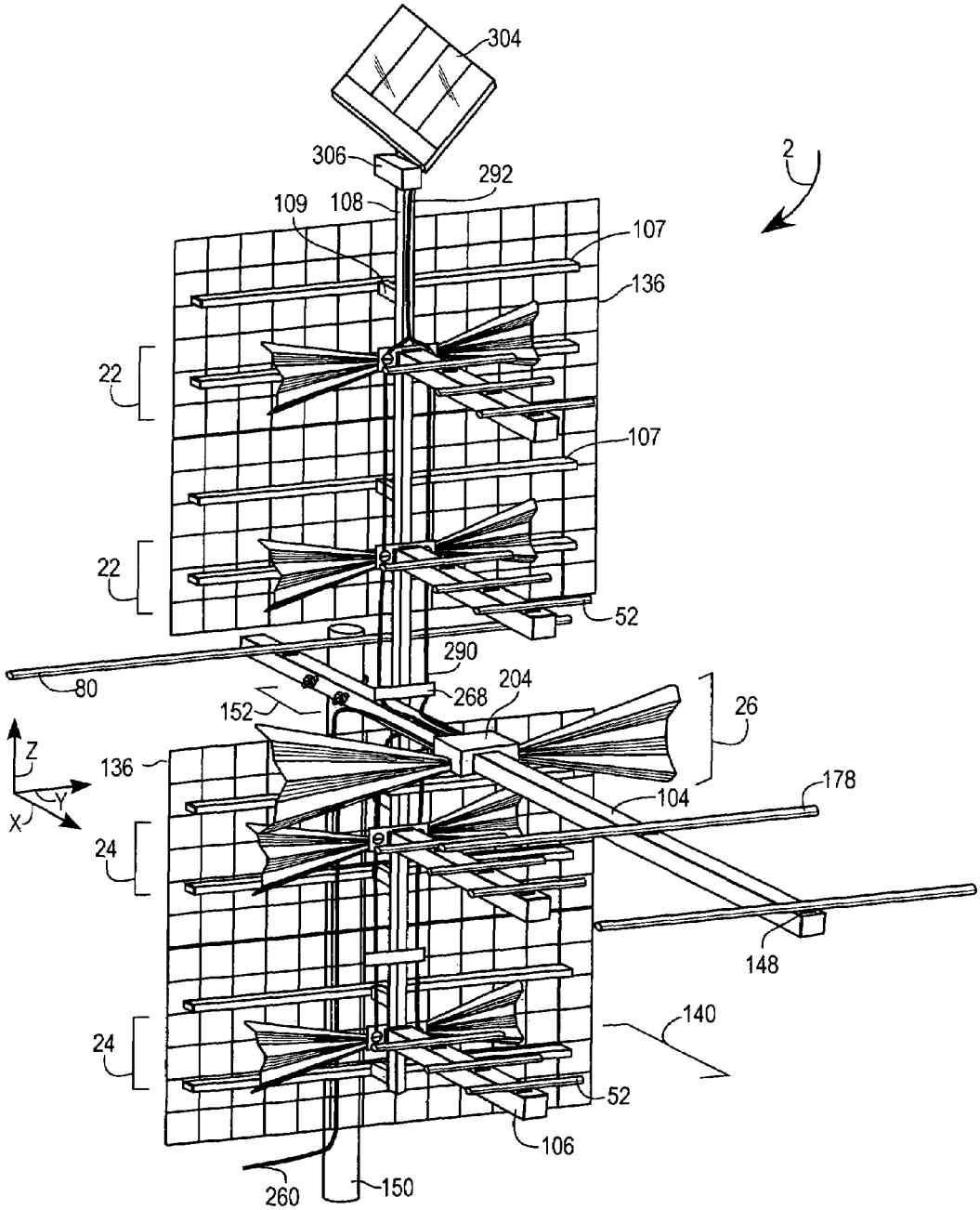
Figure 18:
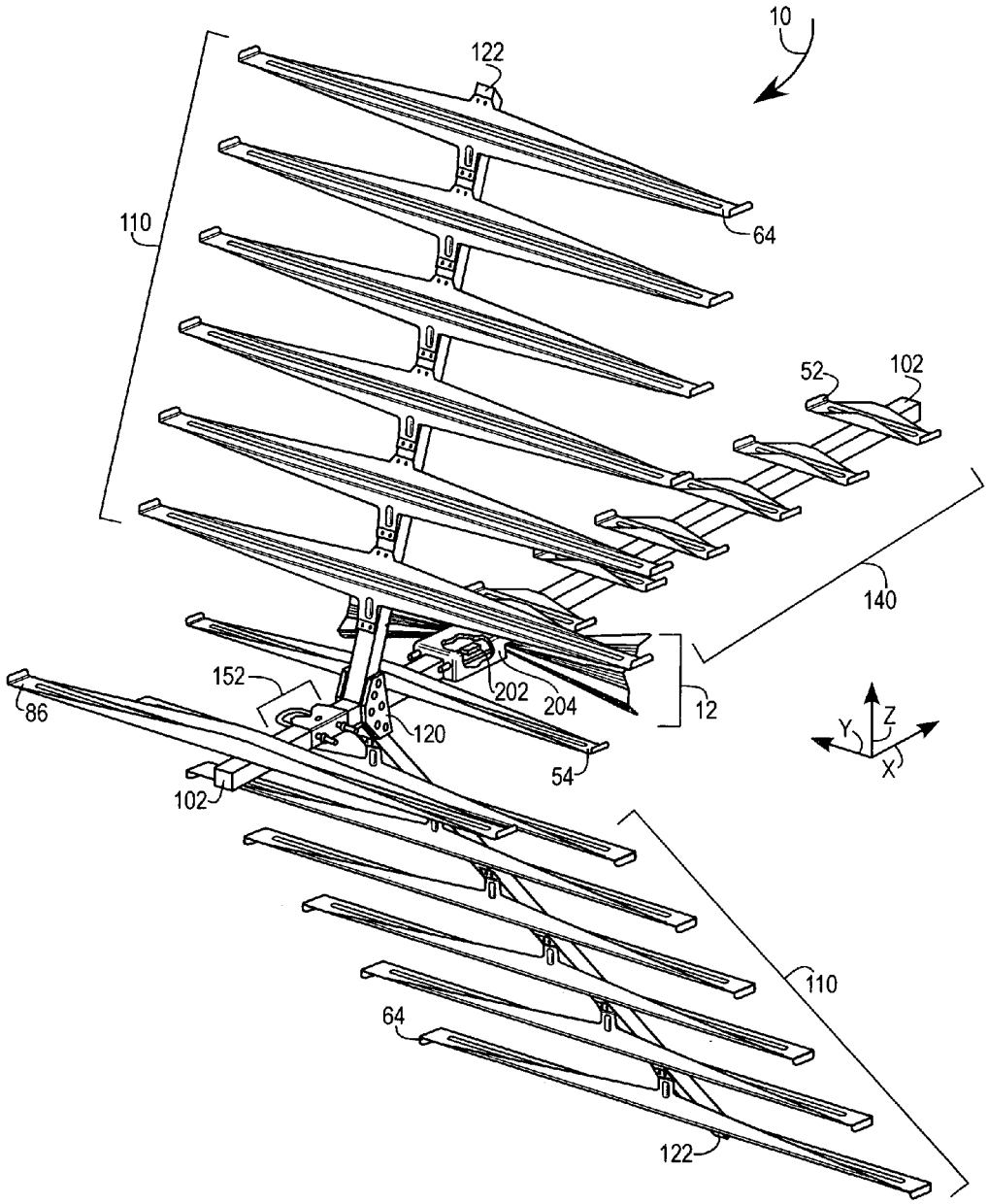
Figure 23:
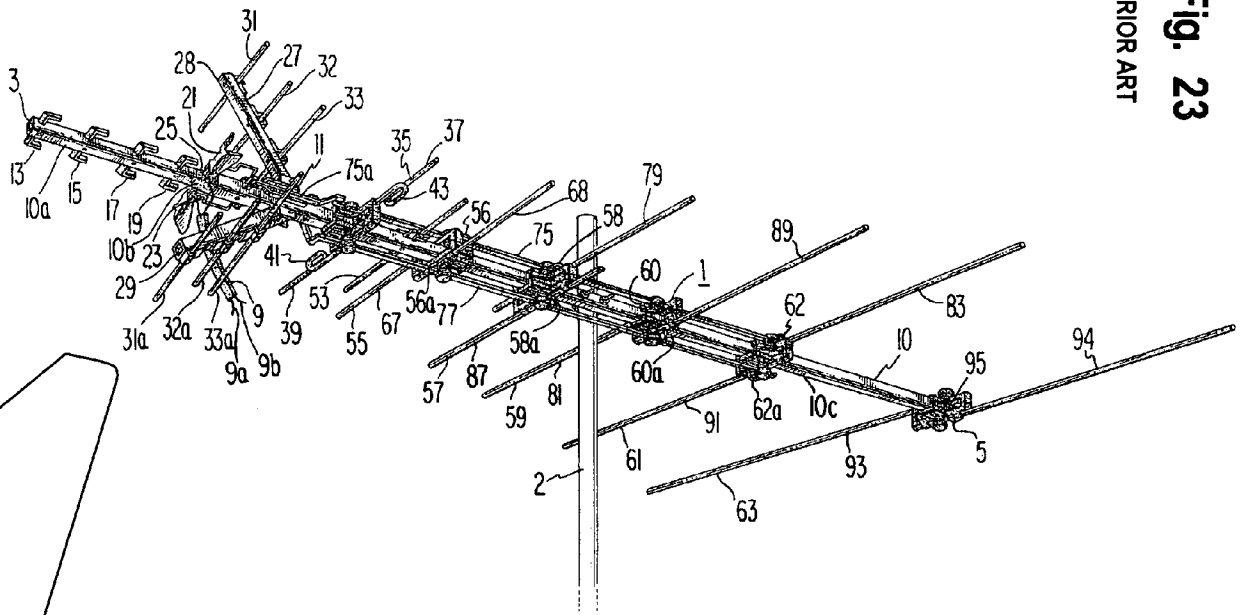
Fig. 23 PRIOR ART
Figure 24:
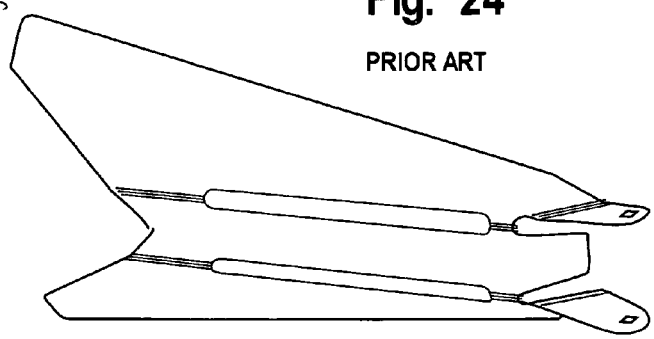
Fig. 24 PRIOR ART

| | |
|---|---|
| FIG. 3 | Perspective view of a perforated DUV Fan Element |
| FIG. 4 | Closeup of RF conductive elements on perforated DUV Fan. |
| FIG. 5 | Single DUV Element Support of folded elongated elements. |
| FIG. 6 | Dual DUV support of folded elongated elements. |
| FIG. 7 | A U Mount DUV dipole around a support boom in schematic elevation. |
| FIG. 8 | A Top Mount DUV dipole above a support boom in schematic elevation. |
| FIG. 9 | A DUV Aster dipole in schematic elevation. |
| FIG. 10 | A DUV Accordion dipole in schematic elevation. |
| FIG. 11 | A dual DUV Loop dipole in schematic elevation. |
| FIG. 12 | A VHF & UHF enhanced DUV antenna in schematic perspective. |
| FIG. 13 | A UV-DUV Antenna with M-DUV and V-DUV dipoles in schematic perspective. |
| FIG. 14 | Two axis rotatable Antenna Mount with lightning rod in perspective. |
| FIG. 15 | A Triple UVU-DUV Antenna in schematic perspective. |
| FIG. 16 | A curved RF Booster with four streamlined elements. |
| FIG. 17 | A 5-DUV Antenna in schematic perspective. |
| FIG. 18 | "Fringe" DUV-Antenna in rear perspective. |
| FIG. 19 | Tapered folded Reflector element in perspective. |
| FIG. 20 | Tapered folded Booster Reflector element in perspective. |
| FIG. 21 | Tapered Conical Streamlined Reflector element. |
| FIG. 22A | Amplifier housing. |
| FIG. 22B | Amplifier housing wall detail. |
| FIG. 22C | Strain relief cable mount. |
| FIG. 23 | A Prior Art high gain VHF & UHF antenna. |
| FIG. 24 | A Prior Art folded dipole element. |

TABLES, COMPONENTS AND PARAMETERS

Table 1 DUV Element configurations dB Signal strengths in dB listed herein are referenced to dBd (to an equivalent dipole receiver, not dBi referenced to an isotropic receiver. For dBi, add 2.15 dB to convert dBd to dBi.)

LD Electrical tip to tip length of DUV dipole.

LE Electrical tip to contact length of DUV element.

LC Contact to contact length between DUV elements

LV Electrical tip to tip length of VHF reflector.

HE Maximum electrical height of DUV element

RHL Ratio of Height of Element HE to Length of Element LE

References: Federal Communications Commission "Study Of Digital Television Field Strength Standards And Testing Procedures" ET Docket No. 05-182, Dec. 9, 2005, Report: FCC 05-199.

DETAILED DESCRIPTION

DUV Antenna: With reference to FIG. 1, in one embodiment of the invention, a DUV antenna 2 comprises a driven DUV element 21 configured to be driven by a Digital UHF VHF (DUV) signal. E.g., the DUV element is preferably configured to be driven by a digital television (DTV) signal, radio signal, or internet signal, having a frequency within one of the UHF range of about 300 MHz to 3 GHz, and/or within the VHF range of about 30 MHz to 300 MHz. The DUV antenna 2 preferably comprises two DUV elements 21 collectively forming a DUV dipole 20. The DUV dipole is preferably configured for the Digital TV and/or digital FM range from about 55 MHz to 801 MHz. Inner RF contacts of DUV elements 21 are RF communicatively connected to a RF feed or signal line 260. DUV antenna 2 comprises an antenna support supporting driven DUV antenna 20, and an RF signal line or cable 260 RF communicatively connected to the DUV element 21 or DUV dipole 20. The antenna support preferably comprises a longitudinal boom 102 connected to mast 150 by boom-mast mount 152.

VHF Reflector: Further referring to FIG. 1, the VHF reception of the DUV antenna 2 is preferably enhanced or boosted by providing a passive VHF reflector 82 configured generally parallel to the DUV element 21 or DUV dipole 20. It is usually mounted on and generally perpendicular to a longitudinal boom 102. Longitudinal boom 102 is usually mounted with a boom-mast mount 152 to a mast 150. E.g., a U-Bolt type mount. For ease of description, consider a reference system positioned with a forward pointing axis or X axis is positioned along the axis bisecting and perpendicular to the major DUV dipole plane, usually parallel to and above the longitudinal boom 102, pointing to the antenna "Front", ("director" end), and away from the "Back", ("reflector end"). The YZ plane is nominally aligned with the major DUV dipole plane, with the Y axis along the DUV dipole's major axis, and the Z axis along the DUV dipole's minor axis. (The DUV dipole may be symmetric about the Y and X axes.) Such VHF reflectors 82 generally improve the VHF gain by about 2-3 dB. A second reflector may add another 0.5 dB. VHF reflector 82 further improves the UHF Front/Back ratio, beneficially reducing UHF multipath reception. The VHF reflector 82 is preferably streamlined along the X axis to reduce wind loading.

The electrical length LV of the VHF reflector 82 is preferably resonant in the VHF range with the length depending on the antenna reception range desired. E.g., LV is generally from about 660 mm (26 in) to about 915 mm (36 in) electrical resonant length for 9.5 mm (0.375 in) diameter elements. The VHF reflector is more preferably configured for the middle to lower end of the VHF High Band where it is generally more difficult to receive desired channels. E.g., in one configuration, the length LV of the VHF reflector 82 is about 732 mm (28.8 in) for a frequency of about 195 MHz (US digital channel 10) near the middle of the VHF High Band. In another configuration the VHF reflector 82 length LV is preferably about 806 mm (31.7") long for 9.5 mm (0.375 in) diameter elements. This beneficially enhances reception near 177 MHz (US channel 7) near the bottom of the VHF high band. In a further configuration, the length LV may be configured longer with about 864 mm (34 in) for resonance of about 149 MHz to improve VHF high and low band reception.

VHF reflector position: Further referring to FIG. 1, the VHF reflector 82 is positioned towards the "Back" along the negative X axis behind the DUV dipole. E.g., reflector 82 is preferably positioned behind the DUV dipole about 30% to 55% of the electrical length LV of the VHF reflector element 82 in some configurations. It is preferably located at about 40% of LV along the negative X axis. This beneficially improves reception around the upper end of the US VHF High Band. E.g., In configurations with a reflector length LV of about 864 mm (34 in), the VHF reflector 82 may be located about 298 mm (11.75 in) to 406 mm (16 in) behind the DUV dipole 20 in the negative X direction. It is preferably located between about 324 mm (12.75 in) and 381 mm (15.0 in), and more preferably at about 349 mm (13.75 in) from the DUV dipole 20.

RF UHF/VHF Booster: With further reference to FIG. 1, in some embodiments, the UHF and VHF reception of the DUV antenna is preferably enhanced by positioning one and usually two UHF/VHF enhancers or RF boosters 110 near the DUV elements 21 and displaced above and/or below the XY plane. These RF boosters 110 comprise one and preferably a plurality of booster reflector elements 62 configured about parallel to the Y axis or the DUV element 21 axis. The booster reflector elements 62 are preferably mounted on one or more UHF/VHF enhancer supports or booster booms 122. The booster booms 122 may be bonded to or mounted on the longitudinal boom 102. Booster booms 122 are preferably mounted on a UHF booster mount 120 on the longitudinal boom 102.

Removing central booster reflector elements: To enhance VHF signals, the RF boosters 110 are preferably configured with a space above and below the X axis, sufficient to permit VHF signals to propagate to and be reflected off of the VHF reflector element 82. E.g., in some configurations, the reflector element nearest the longitudinal axis of a conventional UHF corner reflector is removed from both the upper and lower booms. Removing these elements reduced the UHF gain and UHF Front/Back ratio by about 2 dB. However, displacing the closest reflector elements 62 from the longitudinal X axis by more than the reflector to reflector distance provides a very substantial and unexpected improvement of the VHF signal in comparison to conventional UHF "corner reflectors". E.g., this unexpectedly increases the VHF gain by 2-3 dB in the lower VHF High Band near channel 7, and by about 3-4 dB in the upper VHF High Band near Channel 12.

For example, in one configuration shown in FIG. 1, the reflector elements of a conventional "corner reflector" closest to the longitudinal axis were removed to form an RF booster 110. Two UHF reflector elements 62 on each RF booster 110 were used above and below the longitudinal boom. E.g., in one configuration, the inner reflector elements were spaced at about 135 mm (5.3") from the longitudinal boom, and the outer reflectors at about 224 mm (8.8") from the longitudinal boom, and about 102 mm (4 in) and 13 mm (0.5 in) along the negative X axis from the DUV dipole.

RF Booster Configurations: Referring to FIG. 1, each booster boom 122 may be configured at an angle from about 30 deg to 80 deg to the longitudinal boom or X axis. It is preferably from 50 to 70 deg, and more preferably about 60 deg. In this configuration, the booster elements are positioned about symmetrically above and below the DUV dipole or the XY plane near the top of the longitudinal boom 102. In this configuration, RF boosters 110 are pivoted on booster mount 120 about 29 mm (1⅛ in) above and below the XY plane about 119 mm (4 11/16 in) behind the DUV dipole. In some configurations, the booster boom angle with the longitudinal boom may be reduced to increase UHF gain while reducing the VHF gain, and vice versa. Mount 120 may be asymmetric to position boosters symmetrically about the XY plane in line with DUV dipole and reflector elements mounted on top of boom 120. Mount 120 is preferably symmetric to reduce costs.

Curved Booster Mounts: Referring to FIG. 16, in one embodiment, a curved UHF/VHF RF booster 122 is preferably formed by mounting multiple reflector elements 85 on a curved boom 116 positioned around the DUV dipole 20 in some embodiments. Reflector elements 85 are preferably streamlined in the horizontal plane, and more preferably tapered a wide depth at the center to a low depth at the outer tip. They may be bonded to the curved boom 116, or mounted onto the boom with a fastener, optionally located through a mounting hole 71. One or two curved booms 116 are preferably formed into parabolic curves and configured like a forward pointing Winston or compound parabolic collector to reflect the RF signal to/from the DUV dipole 20. E.g., a first curved boom 116 configured about like a parabola with a first focus F1 is mounted with its axis A1 about at an angle R1 to the longitudinal boom 102. A second curved boom 116 with a second focus F2 is mounted with its axis A2 about at an angle R2 to the longitudinal boom 102.

The first curved boom 116 nominally touches the second focus F2, and the second boom 116 touching the first focus F1. These are configured so that the DUV dipole 20 is positioned about on the plane about midway between the two foci F1 and F2. The angles R1 and R2 are preferably in the range of 5 deg to 75 deg, more preferably in the range of 10 deg to 50 deg and more preferably still within about 20 to 30 deg. Referring to FIG. 1, in some configurations, this curved boom configuration may be approximated by mounting one or two UHF reflector elements nearest the axis on the inner sides of straight booster booms 122 nearest the DUV dipole 20, while mounting reflective elements 62 further away from the longitudinal support on the outer sides of the booster booms 122 away from the DUV dipole 20.

UHF Enhancer: Further referring to FIG. 1, the UHF reception of the DUV dipole 20 is preferably boosted by mounting a plurality of passive RF conductive RF or UHF director elements 50 on the longitudinal boom 102 about parallel to the Y axis and displaced from the DUV dipole 20 towards the "Front" along the positive X axis. The director elements 50 are preferably streamlined to give a low profile in the YZ plane relative to wind in the X direction to reduce horizontal wind loading. The director elements 50 are preferably bonded to the longitudinal boom 102. E.g., by welding, brazing or soldering, such as with a fiber laser, or by adhesive bonding. This beneficially improves durability and reduces cost. The director elements 50 may also be crimped on, or mounted using a fastener such as a rivet, screw or bolt. In some configurations, the RF director elements 50 are preferably about 190 mm (7.5") long, and spaced about 100 mm (4") apart, starting about 50 mm (2") from the DUV element 21. E.g., for 13 mm (0.5 in) wide stampings, or 9.5 mm (0.38 in) diameter cylindrical elements.

DUV Element: With reference to FIG. 3, a DUV antenna may comprise one driven DUV element 21 configured to be driven by a digital electromagnetic signal in at least one of the UHF and the VHF range. The driven DUV element 21 is typically driven by impinging radio frequency (RF) electromagnetic wave. The DUV element 21 may also be driven by an electromagnetic signal from a conductively, capacitatively, inductively, or optically coupled feed or signal line 260. DUV element 21 is preferably configured to be driven in the DTV or DFM range of about 55 MHz to 801 MHz. More preferably, the DUV element is configured to be driven by a digital television signal in one of the VHF High band range (e.g., 170 MHz to 220 MHz), and the UHF range (e.g., 470 MHz to 698 MHz).

With reference to FIG. 3, each DUV element 21 is preferably configured within a height HE to length LE ratio RHL of DUV element 21 of between about 0.01 and 10. DUV elements 21 are preferably configured with their height to length ratio RHL between about 0.1 and 1.0, and more preferably between 0.2 and 0.6. e.g., in one configuration, DUV element 21 was preferably configured with a flat width of 168 mm (6.63 in) folded to a height of about 101 mm (4 in) and with a length of about 251 mm (9.9 in), giving a ratio RHL of Height/Length of about 0.40. The ratio of folded elevation area to unfolded elevation area is preferably between 0.2 and 0.75, and more preferably about 0.6.

DUV Dipole Antenna: With reference to FIG. 2, in one embodiment, the DUV dipole 20 may comprise two driven DUV elements 21 configured in the YZ plane about perpendicular to the longitudinal boom 102 and X-axis. The RF signal line 260 with DUV element 21 or DUV dipole 20 (comprising two DUV elements) collectively form a driven DUV antenna 12. DUV elements 21 are usually similar and mirrored about the XZ plane. They are generally similar and mirrored about the XY plane. However, in some configurations they may be different and/or asymmetric about the X and/or Y axes. In FIG. 2, the DUV elements are nominally shown oriented to the left (L) and right (R) of the X axis pointing to the antenna's "Front." The RF contacts 44 of the DUV element 21 or dipole 20 are RF communicatively connected to the RF signal line 260. In some embodiments, driven DUV antenna 12 preferably comprises an RF DUV amplifier 202 with signal contacts connected to signal line 260, RF contacts 236 connected to element RF contacts 44, preferably using element leads 290.

The DUV dipole is preferably configured for half wave resonance in the VHF High Band (e.g., 174 MHz to 216 MHz) while being configured for three halves resonance in the middle portion of the DTV UHF band (e.g., 522 MHz to 648 MHz). More preferably, the DUV dipole 20 is configured for one half wave resonance near the middle to upper end of the VHF high band (e.g., about 192 MHz-216 MHz) and correspondingly configured for thee halves wave resonance in the respective DTV UHF band (e.g., 576 MHz to 648 MHz). This beneficially retains the very important high UHF gain while increasing VHF High band gain. With wide DUV elements, the element electrical lengths LE may be configured assuming a dipole end effect for the DUV dipole of about 0.7 similar to wide bowtie antennas. Compared to prior art antenna elements configured for the upper end of the UHF band (such as shown in FIG. 24), such driven DUV antennas or dipoles beneficially provide major antenna VHF High Band gain while retaining very good DTV UHF band gain.

DUV Configuration: Referring to FIG. 3, the driven DUV element 21 comprises a radio frequency (RF) conductive component 40 that is part of and/or supported by a structural component 30. The DUV element 21 is preferably designed to survive design peak wind conditions and gravity. Each DUV element 21 comprises a structural element 30 extending outward from a DUV dipole element support 38 near an inner end 99 near the DUV antenna longitudinal axis X, to an outer end 98 away from the DUV antenna axis X. The structural element 30 is preferably positioned generally in the YZ plane about perpendicular to the DUV antenna axis X. Referring to FIG. 2, the DUV antenna preferably comprises a plurality of DUV elements configured as one or more DUV dipoles 20 with an overall electrical resonant length LD. e.g., as DUV elements 21 positioned left and right of the antenna axis X.

RF Conductive Elements: Referring to FIG. 2, each DUV element 21 comprises an RF conductive element 40 extending from near the inner end 99 to about the outer end 98 of the DUV element 21. The RF conductive element 40 comprises a conductive RF contact 44, preferably configured near the inner end 99 of the DUV element. With reference to FIG. 3, FIG. 4 and FIG. 5, in some configurations, the DUV elements have perforations or holes. E.g., to reduce wind loading. In such configurations, the RF conductive element preferably comprises at least two RF elongated conductive elements 42 extending from near the inner end of the DUV element 99 to near the outer end 98 of the DUV element.

Element Length: In some configurations, the electrical length LE of DUV elements 21 (together with half the contact to contact distance LC) is preferably configured for half wave dipole resonance about in the VHF High Band and for three halves resonance in the UHF DTV range. (e.g., about 470 MHz to 698 MHz). LE is measured from about the DUV element RF contact 44 near the inner end 99 to near the outer conductive tip 98. To resonate at or near a prescribed frequency, thin driven dipoles 20 are typically configured using dipole end effect of about 91% to accommodate the dipole end effect. (i.e., the factor to multiply the theoretical dipole to obtain actual resonance). Referring to FIG. 2 and FIG. 3, DUV fan elements with length LE typically require lower dipole end effect factors. E.g., using dipole end effect of about 70% of the theoretical dipole element for the desired resonant wavelength.

In some embodiments, a broadband DTV UHF/VHF DUV dipole is configured with element lengths LE from about 218 mm to 302 mm (8.6 in to about 11.9 in). The DUV dipole is preferably configured with DUV element lengths LE of about 249 mm to 254 mm (9.75 to 10 in) with about a 32 mm (1.25") center contact to contact distance. This gives an overall physical tip to tip DUV dipole length LD of about 527 to 540 mm (20.75 to 21.25 in). E.g., such a DUV dipole with 249 mm (9.75") long elements (and an LC of 32 mm) gave a 3 dB higher performance in the VHF high band than an equivalent dipole with the same length elements made of 13 mm (0.5") diameter conductive rod (e.g., copper). This DUV dipole gave 1.5 to 2.2 dB higher gain than the rod dipole across the DTV UHF range.

A shorter U-DUV dipole is preferably used in some configurations. E.g., with UHF three halves resonance about from 660 MHz to 860 MHz, with VHF half wave resonance above about 220 MHz. U-DUV elements may have lengths LE from about 172 mm to 218 mm (6.8 in to 8.6 in) long. Such lengths enhance higher UHF reception with some reduction in VHF reception. Other configurations may use V-DUV dipoles preferably using longer DUV elements lengths. E.g., using V-DUV elements with an electrical lengths LE of about 267 mm to 330 mm (10.5 in to 13 in) long. This beneficially enhances VHF reception while still having good UHF reception. In further configurations, an X-DUV extended dipole is used with a longer electrical length. E.g., the X-DUV element electrical lengths LE may be about 330 mm to 508 mm (13 in to 20 in) from outer end to contact, and preferably about 356 mm (14 in). This larger X-DUV dipole beneficially enhances both VHF reception and UHF reception above the broadband DUV dipole.

TABLE 1

| DUV Element configurations | | | | | | |
|---|---|---|---|---|---|---|
| | | | | Resonant Frequencies | | |
| | Length | | End | L/2 | 5 L/8 | 3 L/2 |
| Model | mm | in | Factor | MHz | MHz | MHz |
| U-DUV-300 | 159 | 6.3 | 0.7 | 300 | 375 | 900 |
| U-DUV-290 | 165 | 6.5 | 0.7 | 290 | 363 | 870 |
| U-DUV-280 | 172 | 6.8 | 0.7 | 280 | 350 | 840 |
| U-DUV-270 | 178 | 7.0 | 0.7 | 270 | 338 | 810 |
| U-DUV-260 | 186 | 7.3 | 0.7 | 260 | 325 | 780 |
| U-DUV-250 | 194 | 7.6 | 0.7 | 250 | 313 | 750 |
| U-DUV-240 | 203 | 8.0 | 0.7 | 240 | 300 | 720 |
| U-DUV-233 | 210 | 8.3 | 0.7 | 233 | 291 | 698 |
| U-DUV-230 | 212 | 8.4 | 0.7 | 230 | 288 | 690 |
| M-DUV-220 | 223 | 8.8 | 0.7 | 220 | 275 | 660 |
| M-DUV-210 | 234 | 9.2 | 0.7 | 210 | 263 | 630 |
| M-DUV-200 | 246 | 9.7 | 0.7 | 200 | 250 | 600 |
| M-DUV-190 | 260 | 10.2 | 0.7 | 190 | 238 | 570 |
| V-DUV-180 | 276 | 10.9 | 0.7 | 180 | 225 | 540 |
| V-DUV-170 | 293 | 11.5 | 0.7 | 170 | 213 | 510 |
| V-DUV-160 | 312 | 12.3 | 0.7 | 160 | 200 | 480 |
| V-DUV-157 | 335 | 13.2 | 0.7 | 157 | 196 | 470 |
| X-DUV-150 | 334 | 13.1 | 0.7 | 150 | 188 | 450 |
| X-DUV-140 | 359 | 14.1 | 0.7 | 140 | 175 | 420 |
| X-DUV-120 | 421 | 16.6 | 0.7 | 120 | 150 | 360 |
| X-DUV-100 | 509 | 20.0 | 0.7 | 100 | 125 | 300 |
| X-DUV-80 | 640 | 25.2 | 0.7 | 80 | 100 | 240 |
| @ Length LC = | 31.8 | 1.25 | | | | |

Further examples of DUV element configurations are shown in Table 1. These assume an element contact to contact spacing LC of 32 mm (1.25 in). Center to center distance LC may vary from 13 mm to 75 mm (0.5 in to 3 in) with the same tip to tip length LD. These DUV element configurations are shown for nominal half wave resonance frequencies MHz assuming a dipole end effect factor of about 0.7. The corresponding nominal three halfwave resonance is shown along with the five eighths wave resonance. Resonant frequencies within or near UHF DTV band and VHF High band are underlined.

The RF contact 44 preferably covers a portion of at least one surface of the element support 38, and more preferably covering at least a portion of the element support surface about the mount hole 220. The RF conductive elements and structural elements are preferably formed together with the RF contact 44 positioned against corresponding support RF contact.

To reduce wind loading and/or weight, the DUV elements are preferably formed from a sheet of RF conductive perforated metal or bonded wire mesh comprising perforations openings 34. Here sequences of metal between perforations or openings 34 in effect form the RF elongated conductive elements 42 extending outward from the inner end 99. The DUV elements 21 are more preferably formed from a composite of an RF conductive element 40 bonded to a structural element 30. E.g., a mechanically or electrically applied conductive layer 40 formed on or within a fiber reinforced material, or a plastic layer 30.

Element Supports: With reference to FIG. 2, in some embodiments each DUV element 21 preferably comprises at least one and more preferably at least two element supports 38 with which to support the DUV element. (See also FIG. 3, FIG. 5 and FIG. 6.) The element support 38 is preferably configured near the inner end 99 of the DUV element towards the antenna axis X. An element mount hole 220 is preferably formed in at least one and more preferably in at least two of the element supports 38. Structural attachment tabs, or enlarged ends may similarly be used to provide a sturdy attachment.

DUV Fan: Referencing FIG. 2 and FIG. 3, in some configurations, the DUV structural element preferably comprises a triality of three or more stiffening portions, bends or undulations displaced out of a mean YZ plane through the element. More preferably, the DUV element 21 is configured as a DUV Fan 90 wherein the structural component comprises at least three stiffening portions, or folds 31 between at least four elongated element portions 32. More preferably, the DUV Fan 90 comprises seven or more folds 31 between eight or more elongated element portions 32.

The elongated element portions 32 may be formed from trapezoidal segments as shown in FIG. 2. The elongated portions 32 are preferably configured as rectangular segments as shown in FIG. 3. The maximum width WP of the elongated element portions 32 may be between 2% and 75%, and preferably between 5% and 20% of the height HE of the DUV structural element. More preferably, with eight to ten elongated portions 32, their width WP is between about 15% and 8% of the DUV element height HE.

Folded Supports: With reference to FIG. 4 and FIG. 5, in some DUV Fan configurations, one element support 38 is preferably formed by folding together and more preferably bonding together at least two elongated element portions 32. E.g., a folded support formed preferably in the XY plane. As depicted in FIG. 3 and FIG. 6, DUV Fan configurations more preferably comprise an element support 38 formed from at least three elongated element portions 32. Such folded supports 38 beneficially provide improved bending structural support for thin extended materials against both wind and gravity. In other configurations, the folds 31 may be shallower with angles from 5 deg to 85 deg from the XY plane.

Element Stiffener: With reference to FIG. 6, in some configurations, the inner portion of one or more elongated element portions is preferably folded and/or cut sufficiently to form an element stiffener 37 generally perpendicular to the one or more element supports 38. The element stiffener 37 is preferably offset from the element mount hole 220 far enough along the DUV antenna longitudinal axis X to facilitate fastening at least one DUV element support 38 to a DUV element mount. (The element stiffener may also be folded out of the way as desired.) The element stiffener 37 beneficially adds bending stiffness about the Z axis.

Element End Tips/Recess: With reference to FIG. 2, in some configurations, the outer portion of the DUV element or DUV Fan may be cut back by between 2% and 60% from the outer end 98 towards the inner end 99 to form an element end tip 39. The recess is preferably near the center to form multiple tips 39 towards the upper and lower element ends. Alternatively, one or more upper and/or lower portions may be recessed. Preferably, the element is cut back between 4% and 60% of the element length over portion of its height. More preferably between 10% and 30% of the element length. This cutback 39 forms a central notch (or one or two outer notches). It beneficially reduces wind loading.

Element Perforations: With reference to FIG. 3, the DUV element 21 is preferably comprises numerous openings or perforations 34 from near the element support to near the outer end of the DUV element. The perforations are preferably circular or elliptical, but may comprise slots, trapezoids, or other non-elliptical perforations. The non-perforated area of the DUV element is preferably reduced to between 20% and 80% of the DUV element's outer elevation area projected onto a vertical surface in the YZ plane parallel to the DUV element. More preferably, the non-perforated area of the DUV element is reduced to between 50% and 70% of the element's projected area. With reference to FIG. 4, in one configuration, the perforations 34 are preferably formed within the elongated element portions 32 and not within the adjacent fold 31. The perforated structural elements beneficially reduce the wind loading on the DUV Elements, increasing the antenna durability and/or reducing its cost. With reference to FIG. 7, one or more sizeable portions of the DUV element may be removed to similarly reduce wind loading.

Element Mounting: With reference to FIG. 7, in some embodiments, the DUV elements 21 are preferably mounted such that the XY plane through about the middle of the elements is about in alignment with convenient mounting of one or more UHF and VHF gain enhancing components. E.g., the DUV element structural contact 38 (and associated RF contact 44) are preferably mounted in line with preferred vertical configurations of UHF/VHF directors 50, and/or with VHF reflective element 82, such as inline with those elements mounted on top of the longitudinal boom 102. DUV elements 21 preferably each comprising two structural mounts 38 mounted about symmetrically about the XY plane comprising these respective UHF and/or VHF gain enhancing components. DUV elements 21 are preferably mounted within a U-Mount housing 211 that in turn mounts about the longitudinal boom 102.

The DUV elements 21 are preferably structurally mounted using a supportive bonding means such as an epoxy, potting or thermosetting material 228. E.g., the DUV element supports 38 and contacts 44 are potted within a housing 221 mounted on the longitudinal boom 102. This reduces element flexure, fatigue and contact corrosion. In some configurations, potting 228 is used to mount supports 38 and protect contacts 44 with shallow bends and/or without holes 220. RF contact 236 may be bonded to contact 236 on surfaces not in the XY plane. Such methods simplify construction. The U-Mount configuration beneficially enables the DUV dipole antenna to be conveniently mounted in new antennas or to be retrofitted to existing antennas.

Cutout DUV Element: Such longer cutout DUV dipoles provided unexpectedly higher UHF DTV performance than prior art dipoles. The prior art Peterson dipole element shown in FIG. 24 has about a 168 mm (6.63 in) element length LE. A 162% longer DUV dipole embodiment was made with about a 273 mm (10.75 in) DUV element length LE and a similar 32 mm (1.25 in) contact to contact spacing LC. Similar to FIG. 3, the 152 mm (6 in) DUV material height was configured with three folds 31 to form four DUV element portions 32 giving a folded element height HE of 102 mm (4 in). The outer central portion of the DUV element was cut inwards by 146 mm (5.75 in) like the element shown in FIG. 2. This DUV dipole showed about 5.3 to 4.8 dB higher performance than this Peterson dipole in the VHF High band for Channels 8, 10 and 12. Surprisingly, this DUV dipole also showed about 3.5 to 0.5 dB higher gain in the DTV UHF band across channels 18 to 46 than the Peterson dipole. (Even in Channels 55 to 63 this large DUV dipole was within 2.5 dB of the Peterson dipole gain.) The DUV cutout provides much reduced wind resistance vs without.

With further reference to FIG. 7, in configurations such as where further signal gain is desired, an amplifier 202 is preferably configured near and connected to the element RF contacts 44. More preferably the respective amplifier RF contacts 236 are connected to the RF contacts 44 using short flexible leads 246. E.g., from sections of DUV line 246. More preferably, RF contacts 44 are electrically bonded to the respective leads 246 which are electrically bonded to the respective amplifier contacts. DUV amplifier 202 is preferably mounted within a radius R from antenna pointing X axis near the RF contacts 44. E.g., R is preferably less than the dipole element length LE, and more preferably less than half the element length LE. A corresponding signal line 260 is connected to the amplifier signal contacts 246, and preferably electrically bonded to them. Signal line 260 is preferably precut to a common convenient length with a corresponding RF connector bonded to the user end. E.g., 31 m (100 ft) or 16 m (50 ft). This connected configuration forms an amplified DUV dipole antenna that preferably has only one user formable connection at the end of the DUV line. This beneficially provides users with a usable high RF signal gain that avoids numerous losses from signal connections, and which does not degrade with time from wear or corrosion.

With reference to FIG. 8, the DUV dipole antenna may be mounted on top of the longitudinal boom 102. This provides another convenient mount for new or retrofit systems.

DUV Aster: With reference to FIG. 9, in some embodiments the driven dipole is configured as a DUV Diamond dipole 92 having a wider mid section in the YZ plane relative to its smaller inner end 99 and outer end 98. DUV Dipole 92 may comprise two DUV Aster elements 91, comprising a plurality of elongated RF conductive portions 42 radiating out from the RF contact 44 on or near DUV element support 38. E.g., DUV element 91 may comprise a plurality of wires or elongated RF conductive strips 42. Preferably, the RF conductive elongated portions 42 are formed with at least three lengths selected to form resonant dipoles 20 corresponding to wavelengths for at least three RF signal frequencies. More preferably, the elongated RF portion lengths are selected to form at least five resonant dipoles 20 for signal wavelengths corresponding to the center frequencies of at least five transmission frequencies in at least one of the VHF high band and UHF digital TV channels.

In some configurations, the plurality of elongated RF conductive elements comprising the DUV Aster 93 are more preferably configured on the DUV Fan configuration such as shown in FIG. 2, and FIG. 3. Referring to FIG. 4, the plurality of elongated RF conductive elements 42 are preferably formed along a plurality of one or more inter perforation regions 35. They may be formed along DUV folds 31, or DUV element outer edges 33.

DUV Accordion: With reference to FIG. 10, in some embodiments, the driven DUV dipole may be formed as DUV Accordion dipole 94 comprising two DUV accordion elements 95 95 may comprise multiple RF conductive elements 40 RF communicatively connected to an intra antenna RF conductor 294 and to RF contact 44. These RF conductive elements are mounted on or part of an elongated structural element portions 32 supported by an Intra Antenna Boom 108 connected to DUV element support 36. The distributed structural element is preferably formed into an accordion type configuration with a plurality of elongated elements 32 connected by folds 31. The RF conductive elements may be configured similar to the DUV Fan elements shown in FIG. 3, or the DUV Aster shown in FIG. 9. The DUV accordion is preferably perforated to reduce wind loading (such as the perforations 34 shown in FIG. 3.)

DUV Loops: With reference to FIG. 11, the DUV antenna may comprise a DUV Loop dipole 96 having multiple DUV loop elements 97 comprising a plurality of RF conductive loops 46 RF communicatively connected to RF contacts 44 supported by element structural supports 36.

DUV Line: With reference to FIG. 2, in some configurations, the driven DUV element 21 is preferably electromagnetically connected to the RF signal line 260. The driven DUV element is preferably electromagnetically coupled to the RF signal line 260 capable of communicating an electromagnetic signal. The coupling comprises at least one of a conductive, capacitative, inductive, or optical coupling. The coupling may comprise an impedance matching component or balun. The RF signal line 260 may comprise a two conductors. It preferably comprises a low loss coax line, and more preferably a fiber optic line.

For example, the RF contacts 44 of two DUV elements 21 comprising the DUV Dipole 20, are preferably electrically bonded to an impedance matching balun. The balun contacts are preferably bonded to a prescribed length of high performance UHF/VHF line. E.g., 31 m (100 ft) of RG-6 coax line. A similar configuration may be formed by bonding a single DUV element 21 to a balun to a DUV line.

More preferably, a RF optical line comprising an optical fiber, a RF signal transmitter and an RF signal receiver is used between the antenna amplifier 202 and a signal junction or distribution box 280. The degradation of this optical line's RF signal to noise ratio between the RF amplifier 202 and an RF signal line connector 266 connected to one of the signal junction box 280 or a signal converter, does not exceed about 3 dB per 31 m (100 ft) of signal line for UHF signals of at least 400 MHz. E.g., the signal converter may comprise a signal distribution system, a DTV receiver, and/or a DTV transmitter.

Where the signal line 260 comprises an RF optical line, a power line may be incorporated along with the optical line in the signal line 260. Referring to FIG. 17, a renewable energy power supply 302 and energy storage system 304 is preferably configured with the DUV antenna to provide the requisite power through a power line 292 for the amplifier and RF optic line transmitter or receiver. E.g., these may use a photovoltaic panel or small wind turbine together with a battery or capacitor energy storage system.

Contact or Amplifier housing: Referring to FIG. 22A and detail FIG. 22B, the DUV element RF contacts and contacts for DUV line 208 (and any balun as needed) are preferably encapsulated and protected by a housing 204. The housing 204 is preferably formed from non-conductive material such as a plastic, cellulosic or glassy material. This beneficially reduces signal reflection and multi-path generation within the antenna. Referring to detail FIG. 22B, housing 204 is more preferably formed from an RF electromagnetically absorbing material 205. E.g., an RF resistively conductive material that attenuates incident RF signals reflected by the housing by about 3 dB or more. This may use polypropylene impregnated with 5% to 30% carbon black and preferably 7% to 15% carbon black. This RF attenuation further beneficially attenuates electromagnetic radiation incident on the amplifier, RF leads and contacts within the housing 204 by at least 3 dB. More preferably, the housing comprises an RF conductive sheet, mesh or enclosure 207 inside coating 205 to form an RF "Faraday Cage" to isolate the amplifier from transmitting incident RF signals. Housing 204 preferably comprises a second resistive coating 205 interior to enclosure 207.

Housing Surface: Referring to FIG. 22B, the surface 203 of the housing 204 is preferably formed from or coated with a "white" material having a low visible absorptivity and/or a high infrared emissivity to reduce solar heat absorption and/or increase heat radiated from the housing respectively. For example, the housing and/or coating 203 may comprise one or more of zinc sulfide, zirconium oxide, titanium dioxide, barium sulfate, and micaceous ferric oxide to reduce optical absorptivity and/or increase IR emissivity. The ratio of visible electromagnetic absorptivity (0.3 to 3 micrometers) to infrared emissivity (3 micrometers to 50 micrometers) is preferably less than 0.5, which beneficially reduces solar heating of the housing and any enclosed amplifier.

Sealed housing: Referring to FIG. 22A, the housing 204 is preferably sealed by suitable housing seal 208. E.g., a gasket, "O-Ring" or sealant. More preferably, the balun, RF contacts and DUV Line contacts are secured and sealed with a suitable UHF compliant potting compound 228. This configuration beneficially protects the contacts against flexure and/or corrosive components such as moisture. This reduces fatigue and corrosion. Referring to FIG. 22C, external DUV line 260 is preferably mounted on housing 204 with a strain relief cable mount 268 and sealed with potting compound 228. This beneficially reduces fluctuating strain on the amplifier from wind loading on the DUV elements and the DUV line, with a reduction of fatigue and potential failure probability.

Referring to FIG. 22A, the configuration of the DUV element 21 or DUV dipole 20 bonded to a prescribed length of RF signal line 260 (including bonding to and from any balun as needed) provides consumers with a quality Digital UHF/VHF Antenna having only one user connectable electrical connection. This DUV antenna configuration of DUV dipole, balun and DUV line is useful by itself for regions near major transmitters. This configuration beneficially minimizes the number of connections between the antenna driven element and the user application that can corrode and degrade the UHF/VHF signal transmission. This reduces one of the most common causes of progressive TV reception degradation and failure. It further prevents the common problem of fittings being installed incorrectly, and incorrectly configuring connections.

DUV Amplifier: With reference to FIG. 2, in some embodiments, an RF DUV amplifier 202 is preferably connected between the two DUV elements 21 of the DUV dipole 20 and the RF signal line 260. E.g., in a receiver, the two RF signal contacts 236 of the DUV amplifier 202 are communicatively bonded to the two RF contacts 44 of the DUV dipole 20 respectively. The Amplifier Signal Output or input of DUV amplifier 202 is RF communicatively connected to the RF signal line 260. E.g., Amplifier electrical contacts 246 RF connected to DUV signal line 260. The DUV amplifier 202 preferably matches impedance between the DUV antenna 20 and the RF signal line 260. An impedance matcher or balun (not shown) may be provided as needed between the DUV dipole 20 and the DUV amplifier 202.

In some configurations, a grounded DUV amplifier 202 may be configured between a DUV element 21 and a DUV signal line 260. The RF contact of the DUV element 21 is bonded to the amplifier input and the amplifier output bonded to the DUV signal line. When the DUV antenna is used as a transmitter, the amplifier I/O contacts are reversed.

Amplifier Gain: The DUV amplifier 202 preferably provides broad band amplification across a prescribed frequency range. The amplifier may be configured to amplify one or both of VHF and UHF signals. The amplifier is selected to provide at least 6 dB amplification. It preferably has a switch selectable gain to select from multiple gains in the range from 6 dB to 30 dB. E.g., with 3 dB, 6 dB or 9 dB increments from 6 dB to 30 dB. For TV reception, the amplifier preferably includes a suitable low pass or notch filter (or "FM trap") to reduce the amplitude of FM signals relative to TV signals.

Amplifier Location: With reference to FIG. 2, the RF contacts 236 of DUV amplifier 202 are RF communicatively connected to DUV element RF contacts 44. This may use a length of RF line 290 shorter than DUV Dipole length LD, and preferably shorter than DUV element length LE. More preferably, the DUV amplifier RF contacts 236 are close coupled to the RF contacts 44 within a housing 204 using electrically bonded connections.

Strain Relief Connections: Referring to FIG. 7, in some configurations the DUV amplifier's RF contacts 236 are connected directly to RF contacts 44 of the DUV dipole 20 (or DUV elements 21). Referring to FIG. 7, more preferably, a short strain relief RF conductor 290 connects the RF contact 44 with the DUV amplifier I/O contacts 236.

Bonded Contacts: Preferably, the I/O contacts between at least two of the DUV antenna 10 and DUV amplifier 202, the DUV amplifier 202 and RF signal line 260, (including any balun as needed) are communicatively bonded together. E.g., by soldering, brazing, welding, using a conductive adhesive, or similarly electromagnetically connecting contacts. More preferably, the RF line 246 is bonded between the DUV element 21 and the DUV amplifier I/O contact. With an optical DUV line, the optical lines may similarly be fused together at the connections to provide a durable connection.

Enhanced UHF/VHF DUV Antenna: With reference to FIG. 12, a UHF/VHF enhanced DUV antenna 10 embodiment is preferably formed by configuring multiple RF reflector elements 82 and 86 to increase the VHF gain of DUV elements 21 in some configurations. E.g., medium length VHF reflector element 82 of about 732 mm (28.8 in) is preferably mounted on longitudinal boom 102. Boom 102 is shown mounted on mast 150 with boom-mast mount 152. Similarly a VHF reflector element 86 about 864 mm (34 in) long may be mounted on the longitudinal boom 102 with bond 148 behind reflector 82, generally parallel to the driven DUV Elements 21. In some configurations, a plurality of reflectors 82 and/or 86 may be configured above and below the longitudinal boom 102.

The reflector elements 82 and/or 86 are preferably configured to resonate at frequencies around the middle of a desired VHF range. The reflector elements 82 and/or 86 are more preferably configured to resonate at a plurality of prescribed frequencies. These resonant frequencies are more preferably selected from among channel center frequencies within VHF High Band of 174 MHz to 216 MHz. e.g., at least one of DTV Channels 7-13.

Further referring to FIG. 12, Dipole elements 21 are preferably enhanced by RF director 140 comprising multiple RF director elements mounted on boom 102. RF director elements are preferably selected from a short RF director 52, a medium RF director 54, and a long RF director 56. E.g., 178, 191, and 203 mm (7, 7.5 and 8 in) long respectively for 9.5 mm (0.375 in) diameter elements. More preferably, at least one and preferably multiple director elements selected from 52, 54, and 56 are configured to resonate at one or more prescribed frequencies in the UHF range. Eg. One of the frequencies corresponding to the digital UHF TV band in the range of channels 14 to 51.

Dual UV-DUV Antenna: With reference to FIG. 13, one embodiment features a dual DUV antenna comprising two DUV dipoles configured for different frequency ranges for enhanced UHF and/or VHF performance. E.g., one configuration comprises a medium M-DUV dipole 24 comprising two M-DUV elements 25 configured for the upper portion of the VHF High band from about 192 MHz to 216 MHz, and a VHF enhanced V-DUV dipole 26 configured for the lower portion of the VHF high band range from about 174 MHz to 192 MHz for DTV. In this configuration, the V-DUV dipole is preferably configured around the lower portion of the VHF high band. E.g., a Fan type V-DUV dipole with a dipole end factor of 0.7 may have a tip to tip electrical half wave resonant length LD of about 528 mm (20.8 in) corresponding to a frequency of about 186 to 192 MHz (Channel 9.) This may utilize V-DUV element 27 with lengths LE of about 248 mm (9.8 in) with 32 mm (1.25 in) contact to contact spacing LC.

The M-DUV dipole 24 is more preferably configured to provide enhanced gain at a prescribed frequency near the upper portion of the VHF High Band. E.g., the length LD of the M-DUV dipole 24 may be configured for about 467 mm (18.45 in) for a Fan type DUV dipole with an dipole end factor of 0.7 for half wave resonance about 210-216 MHz (Channel 13.) E.g., length LE of M-DUV element 25 may be about 228 mm (8.6 in) with a contact-contact distance LC of 32 mm (1.25 in). This is further three halves wave resonant at about 630-648 MHz (near digital Channels 59-62) in the new DTV UHF band. This UV-DUV dipole combination beneficially has superior gain across the UHF DTV band as well as the VHF high band.

The RF contacts of the V-DUV dipole may be connected to the signal cable or line 260, preferably within a protective housing 204. Where increased gain is needed, the RF contacts of the V-DUV dipole antenna are preferably connected to a suitable DUV amplifier within the housing 204, and the signal line 260 leads are connected to the corresponding RF amplifier contacts.

VHF Reflector Enhancement: The V-DUV dipole 26 configuration shown in FIG. 13 is preferably mounted on a VHF longitudinal boom 104. Boom 104 is preferably mounted on the mast 150 using a dual-axis orientable boom-mast mount 153. The V-DUV dipole is usually enhanced by at least one VHF resonant reflector element 80 mounted on the VHF boom 104, usually with a bond 148, and configured to be resonant for the prescribed VHF frequency range. E.g., near the middle to lower end of the VHF high band. The VHF reflective element 80 may be positioned between 20% to 60% of the length of the reflective element 80, and is preferably positioned between 30% and 50% of that length, along the VHF boom 104 in the negative X direction behind the V-DUV dipole 23. More preferably the reflective element 80 is positioned about in line with the longitudinal axis X about parallel to the V-DUV dipole 26 at about 40% of the length of element 80 behind the V-DUV dipole. E.g., in one configuration, the reflective element 80 is about 864 mm (34 in) long for 9.5 mm (0.375 in) diameter, and is positioned about 249 mm (13.75") behind the V-DUV dipole.

VHF Director Enhancement: V-DUV dipole 26 embodiment of FIG. 13 is preferably enhanced with a VHF director element 178 preferably positioned in the XY plane symmetrically about the antenna longitudinal axis X about parallel to the Y axis or V-DUV dipole 26. The VHF director element 178 is preferably attached to boom 104 by bond 148 (or equivalent fastener), and positioned between 30% and 45% of its length in front of the V-DUV-dipole 26. The VHF director 178 is preferably positioned between 33% and 40%, and more preferably about 36.5% of its length in front of the V-DUV dipole 26. E.g., positioning a VHF director about 635 mm (25" long) at a distance of about 232 mm (9.13") in front of a V-DUV dipole about 737 mm (29") long. Each VHF director element is preferably streamlined to reduce wind loading in the X direction.

Selective VHF Enhancement: Similarly, referring to FIG. 13, at least one and preferably both of the VHF resonant reflector element 80 and the VHF director 178 are more preferably configured to be resonant at a prescribed VHF frequency to enhance the antenna VHF gain in some configurations. The VHF reflector element 80 and VHF director 178 are preferably configured to resonate near the upper and lower ends of a prescribed VHF frequency range. More preferably VHF elements 80 and 178 are configured for the lower and upper frequencies of a particular DTV channel to enhance the VHF gain for that channel.

For example, in one configuration, VHF reflector 80 is preferably configured to resonate near and more preferably slightly below 174 MHz (e.g., digital Channel 7) near or at the bottom of the VHF high band. For this configuration, the VHF reflector 80 is preferably formed to be about 864 mm (34") long. Similarly, VHF director 178 preferably resonates at slightly above 216 MHz (digital Channel 13) at the top end of the VHF high band. E.g., director 178 is preferably configured to be about 610 mm (24") long.

More preferably, the V-DUV dipole 26 is configured to improve performance for a particular Digital TV channel. E.g., to improve performance over 180 MHz to 186 MHz, (for DTV channel 8), the driven DUV dipole length LD is preferably configured about 775 mm (30.5 in) long.

UHF configured U-DUV dipole: Referring to the dual UV-DUV antenna embodiment shown in FIG. 13, the V-DUV dipole 26 is preferably complemented by at least one UHF enhanced U-DUV or M-DUV dipole 22 that is configured for increased gain in the UHF range. The U-DUV dipole 22 may be mounted on the mast 150, or preferably on an intra-antenna boom 108 above (or below) the V-DUV dipole to form a UV-DUV antenna (or VU-DUV antenna). This U-DUV antenna is preferably configured for a prescribed UHF Range. E.g., for a select group of channels within the DTV UHF range of 470 MHz to 698 MHz (DTV channels 14-51.)

UHF Enhancement: Referring to the FIG. 13 embodiment, the U-DUV dipole 22 is preferably provided with further UHF enhancement comprising one of a RF director 140 in front of the U-DUV dipole, and a UHF Screen Reflector 136 behind the U-DUV dipole. The RF director 140 comprises multiple UHF/VHF director elements 52 on a UHF director boom 106. The UHF Screen Reflector 136 may be stiffened by at least one and preferably two stiffener elements or spars 107. The Screen Reflector 136 may be connected to at least one and preferably two standoffs 109. The standoffs 109 may be mounted on the intra antenna boom 108. The reflector width may be 125% to 300% of the length LD of the U-DUV dipole, and preferably about 170% the length of the U-DUV dipole. E.g., 737 mm (29") wide for a 432 mm (17") U-DUV dipole. The reflector height may be 200% to 900% of the U-DUV dipole height HE, and preferably about 500% of HE.

DUV Connections: Referring to FIG. 13, the RF contacts of at least one of the DUV dipoles 22 and 26 may be connected to at least one pair of DUV element leads 290 which join a common RF signal line 260 near those dipoles. (Alternatively, a single DUV element lead 290 may be used in single sided configurations.) DUV element leads 290 are preferably supported by a cable mount 268 to reduce wind induced flexure and contact fatigue. More preferably, the RF contacts from at least one DUV dipole 22 and/or 26 are connected to the RF contacts of at least one amplifier (either directly or via DUV element leads 290). The other RF amplifier contacts are then connected to the RF signal lead 260 together with any remaining unamplified signal leads 290. The amplifier and line connections are preferably encased, and more preferably bonded and sealed within at least one housing 204.

Signal amplification: Referring to FIG. 13 DUV element leads 290 from U-DUV dipole 22 are preferably connected to RF contacts of an UHF/VHF amplifier and more preferably to a UHF amplifier within housing 204. The RF contacts of V-DUV dipole are preferably connected to VHF amplifier within housing 204. The signal output (or input) of the UHF/VHF amplifier or UHF amplifier is preferably mixed with the VHF amplifier output (or input) and connected to the signal line 260.

U-DUV or V-DUV applications: The UHF improved U-DUV dipole 22 or the VHF improved V-DUV dipole 26 described herein may be preferably used in single DUV dipole configurations to further improve the UHF or VHF signal gain. E.g., in the embodiments depicted in one or more of FIG. 1, FIG. 2, FIG. 7, FIG. 8, and FIG. 12, and the corresponding configurations described herein.

Dual Axis Mount: With reference to FIG. 14, the longitudinal boom 102 may be clamped to the mast 150. The longitudinal boom 102 is preferably mounted on the mast 150 with the dual axis boom-mast mount 153. This dual axis boom-mast mount 153 is preferably configurable to rotationally position the DUV antenna about the longitudinal boom 102 (or equivalently rotate antenna about the X axis) and rotationally position the DUV antenna about the generally "vertical" mast axis (or equivalently about the driven antenna Z axis). It further enables "vertical" positioning along the Z axis. The boom-mast mount 153 preferably comprises a bicurved mount 154 positioned between adjacent mast 150 and boom mount 156 surrounding boom 102. The boom mount 156 for boom 102 is preferably curved or rounded to match the respective mating surface of bicurved mount 154. The surface of curved boom mount 156 is more preferably configured to accommodate two curvilinear restraining bolts 158 (or an equivalent tricurved bolt). E.g., the surface of boom mount 156 comprises at least one curved groove 157 for curvilinear bolt 158.

Per FIG. 14, a complementary dual hole washer 160 is preferably positioned on the other side of mast 150. The curvilinear bolts 158 preferably go through a first hole in dual hole washer 160, past the mast 150, around the bicurved mount 154, back past mast 150, and through a second hole of the dual hole washer 160. The curvilinear bolts 158 may be tightened with nuts, cams, or similar tighteners 161. The surface of boom mount 156 may be formed using a cylindrical cover surrounding the boom 102 and bonded to it by a suitable component bond 149 such by welding, brazing, soldering, adhesive etc.

Mounting antenna boom to mast with boom-mast mount 153 may comprise a single triply curved curvilinear bolt (not shown) passing through one hole of dual hole washer 160, past mast 150 and bicurved mount 154, around boom mount 156 and thence back past bicurved mount 154, mast 150 and through the second hole in dual hole washer 160. The dual axis mount 153 beneficially enables users to orient the antenna to match a desired signal polarity relative to the antenna longitudinal boom 102 as well as orient the antenna in a prescribed azimuthal direction about the mast 150.

Structure Mast Mount: Referring to FIG. 14, the mast 150 may be mounted to the structure or ground 168 with a structure-mast mount 166. This structure mast mount 166 is preferably configured to clamp mast 150 vertically, and optionally to orient and clamp mast 150 at a desired azimuthal angle about the vertical, using a second dual axis mount 153. This beneficially enables the antenna to configured in a prescribed azimuthal orientation about the zenith or axis perpendicular to the X-axis.

Lightning Protection: Referring to FIG. 14, a lightning rod 390 is preferably mounted above the antenna, and supported from the mast 150 by an insulated support 392. The lightning rod 390 is electrically isolated from the other components of the antenna system 12. The lightning rod is connected to earth ground 394 by grounding cable 396. Lightning rod 390 and cable 396 are preferably configured behind VHF reflectors, booster and/or screens such as shown in FIG. 1, FIG. 12, FIG. 13, FIG. 15, FIG. 17 and/or FIG. 18. This positioning beneficially helps isolate lightning electromagnetic pulse from the DUV dipole. Considering the antenna is often the highest component of the structure, this lightning protection system beneficially provides some electrical protection to the structure and antenna system against lightning strikes.

Triple UVU-DUV Antenna: With reference to FIG. 15, another DUV antenna system 2 embodiment comprises three DUV antennas configured for a plurality of UHF and/or VHF ranges. E.g., the DUV antennas are preferably selected from U-DUV dipoles 22, M-DUV dipoles 24, and V-DUV dipoles 26 to provide improved gain in the UHF and VHF frequency ranges, such as to form a UVU-DUV antenna as shown in FIG. 15. In another configuration, the UVU-DUV antenna may comprise two U-DUV dipoles 22 and/or M-DUV dipoles 24 configured above and/or below the V-DUV dipole 26. VHF dipole 26 is preferably mounted on VHF longitudinal boom 104 which is mounted on mast 150 with a boom-mast mount 152. RF contacts of U-DUV dipoles 22 and M-DUV may be connected by RF leads 290 supported by cable mounts 268 to cable 260 in housing 204.

Referring further to FIG. 15, preferably one or more dipole RF contacts or RF leads 290 are connected to one or more RF amplifiers 204. The amplifier signal contacts are preferably connected or mixed, (optionally with unamplified RF leads 290), to RF signal line 260. More preferably, the RF contacts of each of the DUV dipoles 22 and 26 are RF communicatively connected to respective RF amplifiers 204. The signal side of these RF amplifiers may be connected together, or preferably mixed together and the resultant RF signal fed to the RF signal line 260. More preferably the amplifiers and line connections are encased, bonded and sealed within multiple housings 204 positioned close to the longitudinal axes of the DUV dipoles 22 and 26.

Further referring to FIG. 15, the U-DUV dipoles 22 and/or M-DUV dipoles 24 are preferably configured for at least one and more preferably for two prescribed UHF ranges. E.g., one U-DUV dipole 22 or M-DUV dipole 24 may be configured for UHF DTV Channels 14-31, and the second U-DUV dipole 22 or M-DUV 24 may be configured for UHF DTV Channels 32-51 respectively. In the configuration shown in FIG. 15, the length LD of the lower M-DUV dipole 24 may be configured for about ¾ the length of the middle V-DUV dipole 26. Correspondingly, the length LD of the upper U-DUV dipole 22 may configured for about ⅔ of the length LD of the middle V-DUV dipole 26.

One or more of U-DUV dipole 22 or M-DUV dipole 24 may be enhanced with RF director elements. E.g., the upper U-DUV dipole 22 in FIG. 15 is shown as UHF enhanced with RF director 140 having three UHF director elements 52 mounted on the UHF director boom 106 supported by intra antenna boom 108. VHF dipole 26 may be enhanced by one and preferably both of VHF reflector 80 mounted behind dipole 26 on VHF boom 104 by bond 148 or equivalent fastener, and VHF director 178 mounted on boom 104 with bond 148 in front of VHF dipole 26.

Further referring to FIG. 15, the U-DUV antennae 22 and 24 are preferably spaced above and below the V-DUV dipole antenna to form a UVU-DUV antenna. Screens 136 are preferably added to boost UHF and/or VHF response of dipoles 22, 24 and/or 26. Reflector screens 136 may be supported by spars 107 and connected via intra antenna standoff 109 to intra antenna boom 108. In such UVU-DUV antenna configurations, UHF reflector screens 136 are preferably separated and displaced from the V-DUV dipole to provide substantial VHF enhancement from reflector screens 136 and/or VHF reflector 80. The reflector screens 136 may be separated by 20% to 200% of the V-DUV dipole length LD. They are preferably separated by between 33% and 100%, and more preferably by about 50% of the length of the V-DUV dipole length LD. One or more similar UHF reflector screens 136 may be formed from curved conductive low drag material with similar restrictions on the spacing between reflectors. One or more U-DUV dipoles are preferably positioned at about the focal length corresponding to the curvature of reflector screens 136.

Further referring to FIG. 15, the U-DUV dipoles 22 (and/or M-DUV dipoles 24) may similarly be configured together above or below the V-DUV dipole 26 to form UUV-DUV antenna or VUU-DUV antenna configurations. In other configurations, a triple VUV-DUV antenna may be configured comprising two V-DUV dipoles 26 above and below one U-DUV dipole 22. These may similarly be configured as VVU-DUV antenna (or UVV-DUV antenna) with the U-DUV dipoles 22 below or above the V-DUV dipoles 26. Other permutations of U-DUV, M-DUV and V-DUV dipoles may be configured to enhance response in corresponding prescribed frequency ranges.

Side by Side Configurations: The multiple U-DUV and/or V-DUV embodiments and configurations described in FIG. 13, FIG. 15, and FIG. 17 may similarly be configured with two or more of U-DUV dipoles 22, M-DUV dipoles 24, and/or V-DUV dipoles 26 positioned side by side. E.g., left/right along the Y axis. For example, two U-DUV dipoles 22 may be configured side by side, and together be positioned above, alongside and/or below a V-DUV dipole 26. Correspondingly, the V-DUV dipole 26 may be configured displaced along the Y axis to the left or right from two U-DUV dipoles 22 positioned one above the other.

Multi DUV Dipole RF connections: Referring to FIG. 15, the DUV dipoles may be connected by DUV element RF signal leads 290 to the RF signal line 260. Each of the DUV dipoles are preferably connected to respective RF amplifiers. The corresponding RF contacts of these RF amplifiers may be connected together, or preferably mixed together and the RF signal connected to the RF signal line 260. More preferably the amplifiers and line connections are encased, bonded and sealed within a plurality of housings 204 positioned near the respective DUV dipole contacts.

Five DUV antenna: With reference to FIG. 17, a combination of five DUV dipoles, comprising U-DUV dipoles 22, M-DUV dipoles and/or V-DUV dipoles 24, are preferably configured into a composite 5-DUV antenna system 2 to provide improved signal gain, directivity, and/or front/back ratio. Additional U-DUV dipole 22, (or M-DUV dipole 24 and/or V-DUV dipole 26,) are added to improve the respective UHF (or VHF) bands. E.g., by about 3 dB each. The U-DUV dipoles are preferably further enhanced by adding one or more RF directors 140 comprising UHF/VHF director elements 52 mounted on respective UHF longitudinal booms 106.

Reflectors 136 are preferably positioned behind the U-DUV dipoles 22 and/or M-DUV dipoles 24 along the negative X direction to improve UHF and/or VHF gain. The reflectors 136 may be stiffened by stiffener elements or spars 107 suitably mounted to optional intra antenna standoff's 109 and connected to one or more intra antenna booms 108 mounted to the VHF longitudinal boom 104. The boom 104 is mounted on the mast 150 with a boom-mast mount (not shown) as in FIG. 12 or FIG. 13. Two to three U-DUV dipoles beneficially improve the UHF gain by about 9 dB. The UHF directors 52 improve directivity and increase signal gain by about 1-2 dB.

As in FIG. 1, UHF/VHF reflector elements may be provided (not shown in FIG. 17). e.g., one to four UHF/VHF reflector elements may be mounted above and/or below boom 104. These UHF/VHF reflector elements may add about 2-5 dB over the UHF range (channels 14 to 51) These U-DUV dipoles, and UHF directors/reflectors may thus be configured to collectively provide about 12 dB to 16 dB higher gain as well as higher directivity.

DUV lead connection and/or amplification: Referring to FIG. 17, four or five U-DUV, M-DUV and/or V-DUV dipoles may be connected via DUV element leads 290 supported by cable mounts 268 as needed to an RF amplifier in housing 204 with the output connected to RF signal line 260. Preferably multiple DUV dipoles and more preferably each of the DUV dipoles are close coupled to respective RF contacts on amplifies within multiple housings 204. The signal amplifier connections may be connected or preferably multiplexed together as described in FIG. 15.

The U-DUV dipoles 22, M-DUV dipoles 24 and respective reflectors 136 are preferably mounted in vertical pairs configured above and below the V-DUV dipole 26 mounted on the VHF boom 104. As described herein, the upper reflector 136 (or pair of reflectors 136) are preferably separated from the lower reflector 136 (or pair of reflectors 136). The separation between upper and lower reflectors may be configured with a gap of 20% to 200%, preferably 33% to 100%, and more preferably with a gap of about 50% of the length of the V-DUV dipole 26. The U-DUV dipoles 22 and/or M-DUV dipoles 24 and respective reflectors 136 may also be configured in horizontal side by side pairs and configured to the left and/or right of the V-DUV dipole 26.

VHF Enhancements: Further referring to FIG. 17, the VHF dipole 26 is preferably enhanced by one or more of VHF reflectors 80, and/or VHF director 178 positioned on VHF boom 104 and bonded to it with bond 148 or equivalent fastener.

Vertical DUV Dipole Positioning: At least one and preferably multiple DUV-dipoles may be vertically positioned during installation at between 50% and 150% of the peak signal relative to the signal minimum to maximum along a vertical axis. The DUV dipoles are preferably installed between 75% and 125% of the peak signal vertical location, more preferablybetween 82% and 108%, and most preferably between 97% and 103% of the peak signal vertical location. This beneficially utilizes the signal enhancement from moire patterns due to reflected signals.

Referring to FIGS. 13, 15 and 17, because UHF signals have different wave-lengths, moire patterns and fringe intervals from VHF signals, at least one U-DUV dipole 22, M-DUV dipole 24 and/or V-DUV dipole 26 is preferably vertically positioned to benefit from local signal moire fringe maximums. Multiple dipoles 22, 24 and/or 26 are more preferably configured vertically so that each U-DUV dipole is positioned near a corresponding UHF fringe maximum.

VHF Booster DUV antenna: Referring to FIG. 18, in one embodiment, a VHF/UHF enhanced DUV antenna 10 is preferably configured with one and more preferably two VHF RF boosters 110 comprising long VHF reflector elements 64 mounted on booms 122 configured to reflect VHF signals onto DUV dipole 12. VHF RF boosters 110 are mounted to longitudinal boom 102 by mount 120 behind DUV dipole 12 and VHF reflector element 86. Longitudinal boom 102 may be mounted using boom-mast mount 152, or preferably a dual axis boom-mast mount. DUV dipole 12 is preferably configured to resonate in the VHF High band. This embodiment enhances UHF response with RF director 140 comprising multiple elements 52 mounted on boom 102. The RF signal is preferably boosted by amplifier 202 in housing 204 close coupled to DUV antenna 12.

UHF reflector: Referring to FIG. 1 and FIG. 18, in some configurations, a UHF reflector 54 is mounted on the longitudinal axis behind the driven antenna. In configurations having RF boosters 110 comprising off axis reflective elements 64, UHF reflector 54 is preferably configured for resonance in the low UHF range. UHF reflector 54 may be positioned behind the DUV dipole by a distance of between one eighths and three eighths, more preferably between about three sixteenths and five sixteenths, and more preferably still by about one quarter the length of UHF reflector. E.g., reflector 54 about 432 mm (17 in) long was positioned about 114 mm (4.5 in) behind the DUV dipole. This configuration increased the forward gain by about 0.7 dB to 1.5 dB, and improved the Front/Back ratio by about 3 dB. This UHF reflector 54 is situated to balance benefits in both the UHF DTV and VHF High Bands.

Element Streamlining: Referring to FIG. 1, in some configurations, the reflector and/or director elements extending transversely to the X axis are preferably streamlined. E.g., by forming the element into an elliptical shape in the XZ plane with a smaller outer dimension along the Z axis relative to a longer outer dimension along the X axis. Referring to FIG. 16 and FIG. 21, VHF reflector elements 85 are preferably streamlined along the X axis.

Element Tapering: Referring to FIG. 16 and FIG. 21, VHF reflector elements 85 are preferably tapered from large at the center down to the element tips. This improves the bending strength while reducing horizontal wind drag. Similarly referring to FIG. 18 and FIG. 19, in some configurations, VHF reflectors 86 or 82, UHF reflectors 54, and/or UHF directors 52 are formed with one or more stiffening bends 66 to stiffen them and increase the bending moment about the X axis. These reflectors or directors are preferably tapered vertically from the longitudinal X axis out to near the element tip. E.g., the long edges of the director elements 52 are bent upwards to form a triangular or tetrahedral stiffener shape 66 with a short stiffener peak positioned about over the center of the UHF director boom 106 (or the X axis). This provides the highest bending stiffness near the middle tapering to the tips. It further reduces wind loading along the X axis.

In some configurations, the edges of the director elements 52 are bent upwards closer to the longitudinal axis of the UHF element near the mount on the boom compared to the outer tips. This beneficially enables the UHF element 52 to be stamped out of rectangular material. In some configurations, an indented stiffener ridge 68 or curved channel is preferably pressed upward about along the axis of the UHF element 52 (about parallel to the Y axis.) This reduces the upward "lift" of the UHF element 52 from the side bends.

In some configurations, the UHF elements 50 and/or VHF elements 80 are preferably stamped out with stiffening risers 66 from diamond shaped material. This provides greater bending stiffness near the X axis tapering to thinner sections near the element tips. The ends of reflective elements 54, 64, or 86, or directive elements 52 are preferably bent upwards for a short distance forming a folded tip 69. This beneficially reduces personal impact hazards and reduces the physical length, facilitating packing and shipping.

Tapered Booster Reflector Elements: Referring to FIG. 18 and FIG. 20, in some configurations UHF booster elements 62 and/or VHF booster elements 64 are preferably bent into shape from flat material with a stiffener on one side bent up and the stiffener on the other side bent down in a Z type pattern. An inner booster attachment tab 58 and/or an outer booster attachment tab 59 are preferably provided on booster reflector element 62 or 64 to attach them to booster boom 122 using fasteners or bonding methods.

Tapered conical streamlined elements: Referring to FIG. 20, in some configurations the VHF elements 80 and/or UHF elements are preferably tapered from their mounting location in the middle outwards the element tips as well as being streamlined. E.g., by forming the outward portions into truncated conical sections joined at their bases about the middle. The mounting location is preferably flattened to facilitate bonding to the respective boom. Where a mounting fastener such as a bolt, or rivet is used, a flattened area and/or a hole 71 is preferably provided on the opposite side of the conical section to facilitate attachment. The conical elements are preferably streamlined into a elliptical conical section to further reduce wind loading. A fastener hole 71 may be configured in the outer surface of the tapered conical reflector 85 about the center. The ends of the tapered conical sections may be cut at a diagonal, reoriented along the X axis, and reconnected. This beneficially reduces the shipping dimension along the Y axis and reduces eye hazzards.

Generally, preferably one or more of the VHF and UHF enhancing elements are streamlined and/or tapered so that the horizontal drag of the VHF or UHF enhancing element is less than 85% of the drag of an enhancing cylindrical element of equal length and cross sectional area.

F-DUV Digital FM antenna: With reference to FIG. 1, in some embodiments, the DUV antenna 2 is preferably configured as a F-DUV antenna for the FM range. E.g., about 88 MHz to 108 MH for digital FM use. For an F-DUV antenna configuration, the amplifier 202 is preferably configured for that FM frequency band, preferably with bandpass filters to select that range and reject nearby DTV signals. For such an F-DUV antenna, one or more of the DUV elements 21, the reflector 82, and the directors 50 and boosters elements 62 preferably configured for the FM spectrum to improve the gain and the front/back ratio.

I-DUV Digital Internet antenna: With reference to FIG. 1, in some embodiments, the antenna 10 is preferably configured as an I-DUV antenna for the high "Internet" UHF range from about 698 MHz to 801 MHz, or similar UHF range above the UHF DTV range.

More preferably, in some embodiments multiple amplifiers are provided, configured for the respective frequency ranges. The amplifiers for the FM, DTV and/or Internet ranges are more preferably configured with appropriate filters (e.g., bandpass, low pass, high pass or diplex filters as needed) to separately amplify and/or transmit the respective signals. Similarly, separate RF signal lines are also preferably provided for the FM, DTV and/or Internet signals. More preferably the FM, DTV and/or Internet signals are communicated using one or more optical fibers.

Generalization

From the foregoing description, it will be appreciated that a novel approach for forming Digital UHF/VHF antennas has been disclosed using one or more methods described herein. While the components, techniques and aspects of the invention have been described with a certain degree of particularity, it is manifest that many changes may be made in the specific designs, constructions and methodology herein above described without departing from the spirit and scope of this disclosure.

Where dimensions are given they are generally for illustrative purpose and are not prescriptive. As the skilled artisan will appreciate, other suitable materials and components may be efficaciously utilized, as needed or desired, giving due consideration to the goals of achieving one or more of the benefits and advantages as taught or suggested herein.

While certain antenna configurations, driven elements, director elements, reflector elements, resonant elements, amplifiers, lines, baluns, bonds, supports and mounts are shown in some configuration for some embodiments, combinations of those configurations may be efficaciously utilized. The active and/or passive element lengths, heights, spacing and other element, component, and structural dimensions and parameters for antenna systems may be used.

Where the terms RF, VHF, UHF, FM, Internet, driven, active, passive, reflector, and director have been used, the methods are generally applicable to other combinations of those elements. Where streamlined and/or tapered elements are described, other stamped or cylindrical elements may be used.

Where assembly methods are described, various alternative assembly methods may be efficaciously utilized to achieve configurations to achieve the benefits and advantages of one or more of the embodiments as taught or suggested herein.

Where longitudinal, axial, transverse, vertical, orientation, or other directions are referred to, it will be appreciated that any general coordinate system using curvilinear coordinates may be utilized. Similarly, the antenna element orientations may be generally rearranged to achieve other beneficial combinations of the features and methods described.

While the components, techniques and aspects of the invention have been described with a certain degree of particularity, it is manifest that many changes may be made in the specific designs, constructions and methodology herein above described without departing from the spirit and scope of this disclosure.

Various modifications and applications of the invention may occur to those who are skilled in the art, without departing from the true spirit or scope of the invention. It should be understood that the invention is not limited to the embodiments set forth herein for purposes of exemplification, but includes the full range of equivalency to which each element is entitled.

We claim:

1. A DUV antenna having a forward pointing X axis comprising:

an antenna support:

a driven antenna comprising two antenna elements, each antenna element having;

an inner RF element contact; and an antenna element support attached to the antenna support;

a plurality of passive RF enhancers selected from:

an RF booster comprising an RF reflective element displaced from the X axis and supported by the antenna support;

a VHF enhancer supported by the antenna support, comprising one of:

a VHF reflector, and a VHF director; and a UHF enhancer supported by the antenna support, comprising one of:

a UHF reflector, and UHF director; and a signal line communicatively connected to the DUV RF contacts;

wherein the driven antenna is configured for a first odd to even rational number wave resonance within a prescribed UHF frequency range, and, a second odd to even rational number wave resonance within a prescribed VHF frequency range;

wherein the driven antenna has an electrical length LD between 375 mm and 1192 mm; and wherein the plurality of passive RF enhancers are configured to enhance the driven DUV antenna performance in the prescribed UHF frequency range and in the prescribed VHF frequency range.

2. The DUV antenna of claim 1 further comprising an RF amplifier having amplifier RF contacts communicatively connected to the antenna element RF contacts using bonded connections, and having amplifier signal contacts communicatively connected to the signal line.

3. The DUV antenna of claim 2 further comprising one of a signal junction box and a signal converter, connected to the signal line, wherein the RF signal is transmitted optically between the RF amplifier and the signal junction box and/or the signal converter.

4. The DUV amplifier of claim 3 further comprising an energy storage system, and renewable power supply configured to power the RF amplifier.

5. The DUV amplifier of claim 2 comprising RF attenuative housing around the DUV amplifier configured to reduce by at least 3 dB one of: the RF signal reflected from the interior of the housing, the RF signal reflected from the exterior of the housing, and the RF signal transmitted through the housing.

6. The DUV amplifier of claim 5 comprising a housing having a optically selective outer surface having a ratio of visible absorptivity to infrared emissivity of less than 0.5.

7. The DUV antenna of claim 2 comprising an RF connector bonded to the signal line, wherein the RF connector is the only unbonded connection between the RF element contacts and the RF connector.

8. The DUV antenna of claim 2 wherein the RF amplifier is positioned within a radius of half the length LE of the driven antenna element, from the antenna pointing X axis.

9. The DUV antenna of claim 2, wherein degradation of the RF signal to noise ratio between the DUV amplifier and the signal line connector does not exceed about 3 dB per 31 m (100 ft) of signal line for UHF signals of at least 400 MHz.

10. The DUV antenna of claim 1 further comprising a plurality of driven antennas.

11. The DUV antenna of claim 10 further comprising a plurality of RF amplifiers communicatively connected to the driven antennas wherein multiple amplifier signals are diplexed together to the signal line.

12. The DUV antenna of claim 1, wherein the driven antenna is configured: for three halves wave resonance in the UHF range between about 470 MHz and 698 MHz; and for one of one half wave resonance and five eighths wave resonance in the VHF range between about 170 MHz and 233 MHz.

13. The DUV antenna of claim 1, wherein the driven antenna is configured for resonance in the high UHF range from 698 MHz to 801 MHz.

14. The DUV antenna of claim 1 wherein the VHF enhancer comprises one of streamlined elements and tapered elements having an X axis drag less than 85% of the drag of VHF enhancer cylindrical elements of equal length and cross sectional area.

15. The DUV antenna of claim 1 further comprising:

a bonded RF connection between each antenna element RF contact and the signal line; and an encapsulating material surrounding one of: the antenna element supports; the antenna element RF contacts, and said bonded RF connections.

16. The DUV antenna of claim 1 further comprising a dual axis orientable mount and an antenna support, wherein the DUV antenna is mountable with a prescribed orientation about the pointing axis, and a prescribed azimuthal orientation about an antenna support axis perpendicular to the pointing axis.

17. The DUV antenna of claim 1 further comprising a lightning rod electrically isolated from the other antenna components, and conductively connected to an earth ground.

18. A DUV Antenna having a peak antenna gain along a X axis comprising:

two RF antenna elements; each antenna element having an RF conductive component with an outer conductive length and width measured normal to the X axis;

wherein the RF conductive length to height ratio is between 1 to 10 and 10 to 1;

a structural support component comprising a triality of stiffening bends to withstand wind forces; and an element support;

an antenna support supporting the two element supports;

an RF signal line RF connected to the two element RF contacts; and an RF connector RF connected to the RF signal line;

wherein the DUV antenna is configured for enhanced gain with digital signals in a prescribed RF frequency range.

19. The DUV antenna of claim 18 wherein the RF antenna element comprises three stiffening bends between RF conductive components, oriented from near the antenna element mount to an outer portion of the antenna element.

20. The DUV antenna of claim 19 wherein the dipole element support comprises a plurality of DUV element portions folded together.

21. The DUV antenna of claim 19 wherein the RF contact is positioned on a surface of the antenna element mount.

22. The DUV antenna of claim 18 further comprising a radio frequency amplifier RF with RF contacts communicatively connected to the antenna element RF contacts, and with signal contacts communicatively connected to a signal line, wherein the amplifier is located within a radius of the antenna element length to the element RF contacts.

23. The DUV antenna of claim 22 comprising a supporting housing, wherein the element RF contacts, element structural supports, and amplifier contacts are environmentally sealed within the supporting housing.

24. The DUV antenna of claim 18 wherein the DUV element comprises at least three conductive elements extending outwards from the RF contact.

25. The DUV antenna element of claim 18, wherein the length to height ratio of each DUV element is between 0.20 and 3.0.

26. The DUV antenna of claim 18 further comprising a plurality of perforations in the DUV antenna element, wherein the remaining element material comprises between 20% and 80% of the DUV element area when projected onto a vertical surface parallel to the DUV element.

27. The DUV antenna of claim 18 wherein the structural support component has a folded height to flat height ratio of less than 0.75.

28. The DUV antenna of claim 18 wherein the antenna element has a outer portion cutback greater than 10% of the element length.

29. A method of configuring a DUV antenna having a pointing axis, a driven antenna, multiple passive RF enhancement components selected from a reflector element positioned across the axis behind the driven antenna; a reflective booster element positioned off the pointing axis near the driven antenna; and a directive element positioned across the axis in front of the driven antenna; and an RF connector, the method comprising:

configuring the driven antenna for:

a first odd/even rational wavelength resonance near a UHF frequency in the range of 300 MHz to 810 MHz; and a second odd/even rational wavelength resonance near a VHF frequency in the range of 100 MHz to 270 MHz;

configuring the lengths and positions of the multiple passive RF enhancement components; and communicating an RF signal between the driven antenna and an RF connector;

wherein providing enhanced RF performance between the driven antenna and the RF connector in the prescribed UHF range and in the prescribed VHF range.

30. The antenna configuring method of claim 29 further comprising forming the reflective booster element shorter than the driven antenna length, and positioning the reflective booster element away from the X axis by between three eighths and five eighths the driven antenna length.

31. The antenna configuring method of claim 30 further comprising configuring the reflective booster element and the UHF reflector element with about equal lengths.

32. The antenna configuring method of claim 29 further configuring the driven antenna for about five eighths wave resonance near the VHF frequency and for about three halves resonance near the UHF frequency.

33. The antenna configuring method of claim 29 further configuring the driven antenna for about one half wave resonance within or near the VHF frequency and for about three halves resonance near the UHF frequency.

34. The antenna configuring method of claim 29 wherein the antenna comprises an amplifier, the method further comprising amplifying the RF signal, electrically communicating the RF signal with the driven antenna, converting between an electrical RF signal and an optical RF signal, and optically communicating the RF signal with the RF connector.

35. The antenna configuring method of claim 29 comprising protecting the RF communication link between driven antenna and the RF connector from one of corrosive action and mechanical fatigue.

36. The antenna configuring method of claim 29, wherein the DUV antenna comprises multiple driven antennas; the method further comprising configuring each driven antenna and the multiple RF enhancement components for enhanced RF performance in a respective prescribed UHF range and VHF range; and communicating the respective RF signal between each driven antenna and the RF connector.

37. The antenna configuring method of claim 29 further comprising positioning the VHF reflector element behind the driven antenna by a distance between about 30% to 55% of the length of the VHF reflector element.

38. The antenna configuring method of claim 29 further comprising positioning the UHF reflector element behind the driven antenna by a distance between about 12.5% and 37.5% of the length of the UHF reflector element.

39. The antenna configuring method of claim 29 comprising supporting multiple reflective booster elements on a booster boom, and orienting the booster boom at an angle to the X axis between about fifty degrees and seventy degrees.

40. The antenna configuring method of claim 29 comprising configuring a curved booster boom about like a compound parabolic collector surface positioned with the driven antenna about in the plane through the parabola's focus perpendicular to the X axis; configuring the booster's parabolic axis at an angle between about ten degrees and fifty degrees with the X axis; and positioning multiple reflective booster elements along the curved booster boom and transverse to the boom.

41. The antenna configuring method of claim 29 further comprising one of: vertically positioning the driven antenna to within 75% and 125% of a local RF signal maxima; and orienting the driven antenna about the pointing axis to within 75% and 125% of the local RF polarization.

42. The antenna configuring method of claim 29 wherein the antenna comprises one or more reflective screens, the method further comprising separating by between about 33% and 100% of the driven antenna length LD one of: the reflective screen and the driven antenna, and multiple reflective screens.

* * * * *